US007540541B2

(12) United States Patent
Yoneyama et al.

(10) Patent No.: US 7,540,541 B2
(45) Date of Patent: Jun. 2, 2009

(54) APPARATUS FOR OPENING AND CLOSING DOOR

(75) Inventors: Fumihiro Yoneyama, Yamanashi (JP); Shintaro Mochizuki, Yamanashi (JP)

(73) Assignee: Mitsui Mining & Smelting Co., Ltd., Tokyo (JP)

( * ) Notice: Subject to any disclaimer, the term of this patent is extended or adjusted under 35 U.S.C. 154(b) by 0 days.

(21) Appl. No.: 10/951,802

(22) Filed: Sep. 29, 2004

(65) Prior Publication Data

US 2005/0099017 A1 May 12, 2005

(30) Foreign Application Priority Data

Nov. 6, 2003 (JP) ..... 2003-376629

(51) Int. Cl.
*E05C 3/26* (2006.01)

(52) U.S. Cl. ..... 292/216; 292/201; 292/DIG. 23

(58) Field of Classification Search ..... 292/216, 292/201, DIG. 23
See application file for complete search history.

(56) References Cited

U.S. PATENT DOCUMENTS

| | | | | |
|---|---|---|---|---|
| 3,781,045 | A * | 12/1973 | Watermann | 292/216 |
| 4,968,074 | A * | 11/1990 | Yamagishi et al. | 292/201 |
| 5,605,363 | A * | 2/1997 | Kapes | 292/196 |
| 6,032,987 | A * | 3/2000 | Fukumoto et al. | 292/216 |
| 6,332,634 | B1 * | 12/2001 | Fukumoto et al. | 292/201 |
| 6,409,233 | B1 * | 6/2002 | Hanaki | 292/144 |
| 6,561,557 | B2 * | 5/2003 | Choi | 292/336.3 |
| 6,722,714 | B2 * | 4/2004 | Ooe et al. | 292/216 |
| 2005/0057047 | A1 * | 3/2005 | Kachouh et al. | 292/201 |
| 2005/0099016 | A1 * | 5/2005 | Inoue | 292/216 |

FOREIGN PATENT DOCUMENTS

| | | | |
|---|---|---|---|
| JP | 63-47480 | A | 2/1988 |
| JP | 4-7431 | B2 | 2/1992 |
| JP | HEI 7-6395 | Y2 | 2/1995 |
| JP | 11-286963 | A | 10/1999 |
| JP | 3135341 | B2 | 12/2000 |
| JP | 2001-1759 | A | 1/2001 |
| JP | 3234537 | B2 | 9/2001 |
| JP | 3364566 | B2 | 10/2002 |
| JP | 2002-322834 | A | 11/2002 |

* cited by examiner

*Primary Examiner*—Carlos Lugo
*Assistant Examiner*—Kristina R Fulton
(74) *Attorney, Agent, or Firm*—Sughrue Mion, PLLC

(57) ABSTRACT

An apparatus for opening and closing a door of a vehicle includes a knob that is arranged on one door panel, a holding unit that holds the door in a fully closed state, a control unit that is arranged on other door panel, and allows opening and closing of the door by releasing the holding unit in response to an operation of the knob, a link unit that is arranged outside of a moving area of an opening/closing member that opens and closes a window opening of the door, a first wire cable that connects the link unit to the knob, and a second wire cable that connects the link unit to the control unit. The operation of the knob is transmitted to the link unit, and the operation transmitted is relayed by the link unit to the control unit, making the control unit operate.

7 Claims, 20 Drawing Sheets

APPARATUS FOR OPENING AND CLOSING DOOR

BACKGROUND OF THE INVENTION

1.) Field of the Invention

The present invention relates to an apparatus for opening and closing a door of a vehicle.

2.) Description of the Related Art

In a vehicle, an apparatus for opening and closing a door that releases an engagement of a fully closing holding unit with a striker in a vehicle body to allow a door to be opened is equipped. The engagement is released when a user operates an outside knob provided on an outer-side vehicle door panel (hereinafter, "outer panel") or an inside knob provided on an inner-side vehicle door panel (hereinafter, "inner panel"). Typical apparatus for opening and closing a door includes a control unit common for the outside knob and the inside knob, being arranged between the outside and inside knobs and the fully closing holding unit. The control unit is attached to, for example, the inner panel, and controls to open the door in response to an operation of the outside knob or of the inside knob by transmitting a door opening operation to the fully closing holding unit. The control unit thereby disengages the fully closing holding unit from the striker.

Generally, the vehicle door is equipped with an opening/closing member, such as a window glass. The opening/closing member is arranged to be vertically movable between the outer panel and the inner panel. The opening/closing member is moved vertically to open or close the window when, for example, a regulator knob or a regulator switch is operated.

In such a door that includes the opening/closing member, it is necessary to prepare a space for the opening/closing member to be moved (hereinafter, "opening/closing movement area") between the outer panel and the inner panel. As a result, a space for the apparatus is limited between the outer panel and the inner panel, and a connecting unit that transmits the operation of the outside knob to the control unit cannot be arranged in a straight line. Therefore, the connecting unit is arranged in such a manner that the connecting unit detours the opening/closing movement area. In a conventional technology, a link unit, such as a bell-crank, is arranged in an area closer to a front side of the vehicle than the opening/closing movement area, and the operation of the outside knob is transmitted to the control unit through the link unit. Such a method is disclosed in, for example, Japanese Utility Model Application Laid-Open No. H7-6395 and Japanese Patent Application Laid-Open No. 2001-1759.

As a related technology, a method in which the outside knob is connected to the control unit by a wire cable is disclosed in Japanese Patent Application Laid-Open No. S63-47480. The wire cable is bent outside of the opening/closing movement area.

However, in the method using the link unit such as the bell-crank, a smooth operation of the apparatus cannot be ensured unless the outside knob, the control unit, and the link unit are arranged at accurate positions. This requires not only accurate positioning of each of components at an assembly, but also an inspection and adjustment after the assembly. As a result, it becomes considerably complicated to manufacture the apparatus.

On the other hand, in the method using the wire cable, even if a positional deviation occurs between the outside knob and the control unit, the wire cable can absorb the positional deviation. Therefore, it is not that complicated to manufacture the apparatus, compared to the technology described above.

However, the wire cable bent may not always be operated smoothly. In addition, the wire cables may possibly cause occurrence of a transmission loss when the operation at the outside knob is transmitted to the control unit, resulting a trouble that the control unit cannot accurately perform the operation to open the door.

The above problems occur not only between the outside knob and the control unit, but also between the inside knob and the control unit if the control unit is arranged on the outer panel.

SUMMARY OF THE INVENTION

It is an object of the present invention to solve at least the above problems in the conventional technology.

An apparatus for opening and closing a door of a vehicle applied to a door that includes an opening/closing member that is arranged between a first door panel and a second door panel, and that moves to open or close a window opening according to one aspect of the present invention includes a knob that is arranged on the first door panel; a holding unit that holds the door in a fully closed state; a control unit that is arranged on the second door panel, and that allows opening and closing of the door by releasing the holding unit in response to an operation of the knob; a link unit that is arranged outside of a moving area of the opening/closing member; a first wire cable that connects the link unit to the knob; and a second wire cable that connects the link unit to the control unit. The operation of the knob is transmitted to the link unit through the first wire cable, and the operation transmitted is relayed by the link unit to the control unit through the second wire cable, making the control unit operate.

An apparatus for opening and closing a door of a vehicle applied to a door that includes an opening/closing member that is arranged between a first door panel and a second door panel, and that moves to open or close a window opening according to another aspect of the present invention includes an outside knob that is arranged on the first door panel; a first holding unit that holds the door in a fully closed state; a control unit that is arranged on the second door panel, and that allows opening and closing of the door by releasing the first holding unit in response to an operation of the outside knob; a link unit that is arranged outside of a moving area of the opening/closing member; a first wire cable that connects the link unit to the outside knob; and a second wire cable that connects the link unit to the control unit. The operation of the outside knob is transmitted to the link unit through the first wire cable, and the operation transmitted is relayed by the link unit to the control unit through the second wire cable, making the control unit operate.

The other objects, features, and advantages of the present invention are specifically set forth in or will become apparent from the following detailed description of the invention when read in conjunction with the accompanying drawings.

DETAILED DESCRIPTION

Exemplary embodiments of an apparatus for opening and closing a door according to the present invention are explained below in detail with reference to the accompanying drawings.

Figure 1:
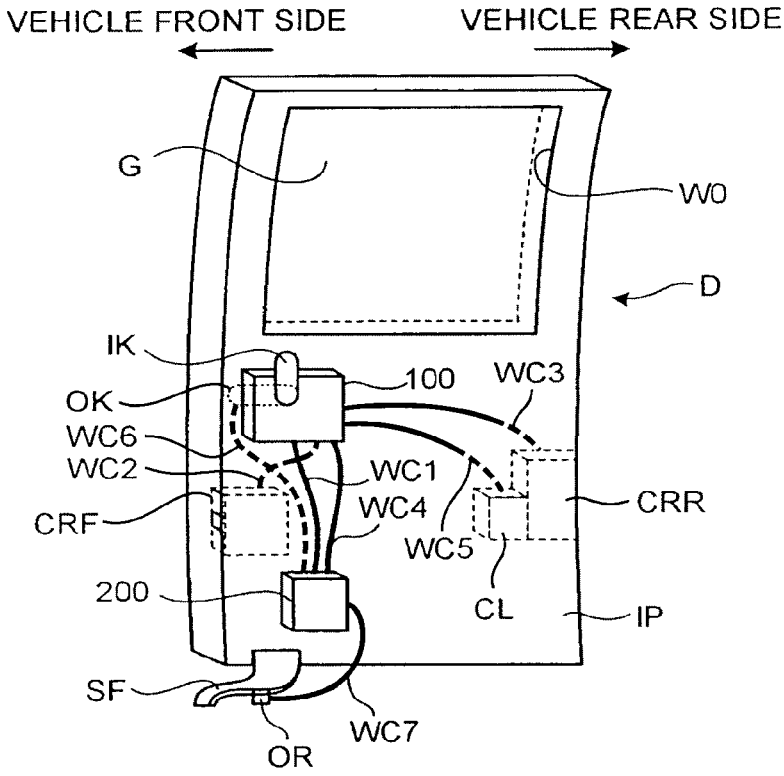
FIG. 1 is a perspective view of a slide door to which an apparatus for opening and closing a door according to an embodiment of the present invention is applied.
Figure 2:
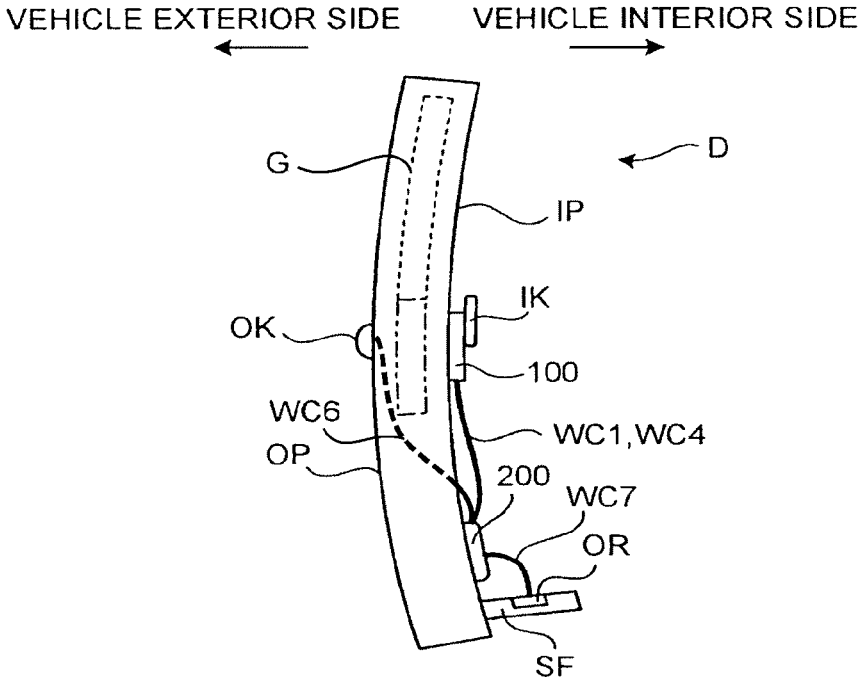
FIG. 2 is a front view of the slide door shown in FIG. 1.
Figure 3:
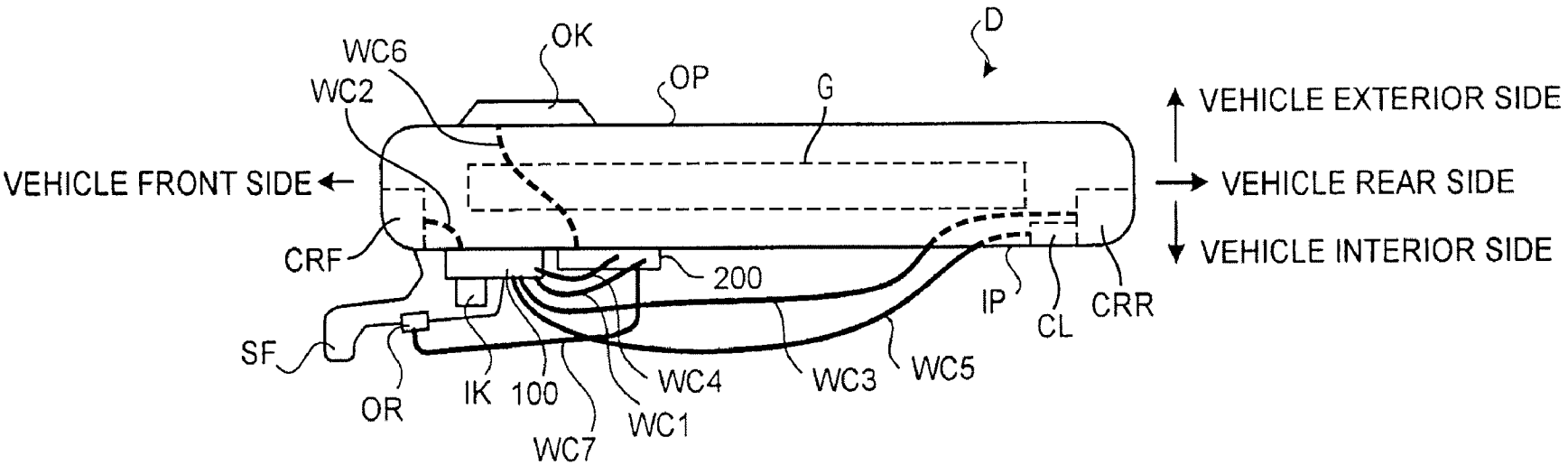
FIG. 3 is a plan view of the slide door shown in FIG. 1.
Figure 4:
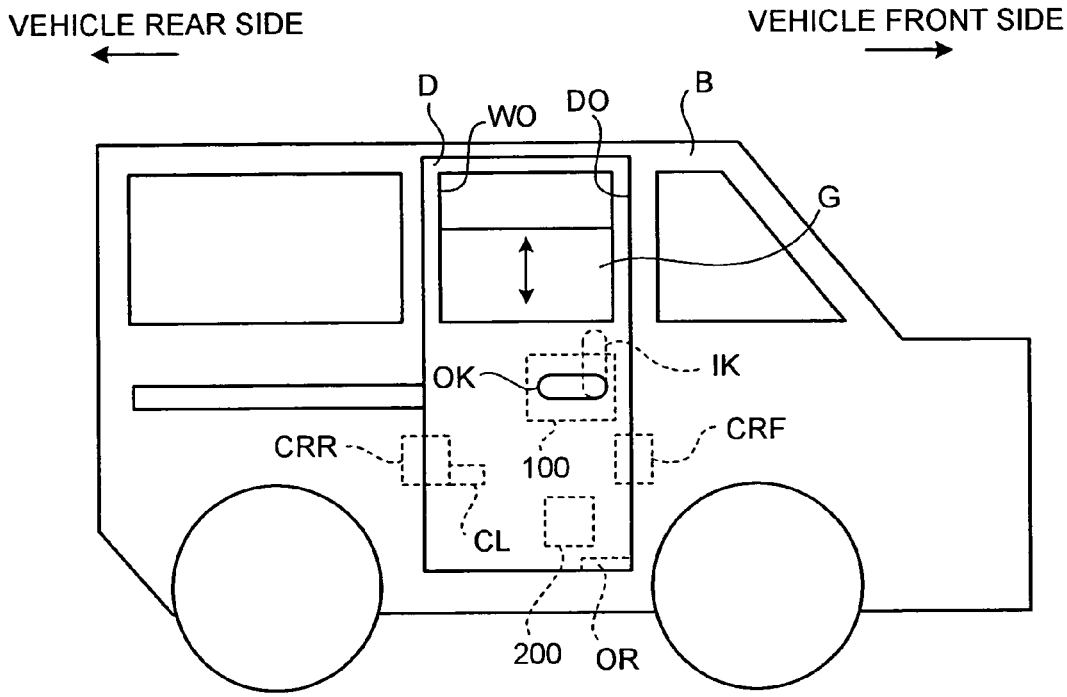
FIG. 4 is a side view of a four-wheel vehicle that includes the slide door shown in FIG. 1.

FIGS. 1 to 3 are conceptual views of an apparatus for opening and closing a door according to an embodiment of the present invention. FIG. 4 is a side view of a four-wheel vehicle that includes the apparatus. The apparatus shown in FIGS. 1 to 3 is arranged between a vehicle body B of a four-wheel vehicle and a slide door D, as shown in FIG. 4. The apparatus includes a fully closing latch unit CR (not shown) that serves as a fully closing holding unit, a fully opening latch unit OR that serves as a fully opening holding unit, a control unit 100, and a link unit 200.

The slide door D, to which the apparatus is applied, opens or closes a door opening DO through which a passenger enters to a vehicle by sliding along a side body of the vehicle. The slide door D includes, in an upper portion of the slide door D, a window opening WO that is opened or closed by a window glass G. As shown in FIGS. 2 and 3, the window glass G is arranged between an outer panel OP and an inner panel IP such that the window glass is movable in a vertical direction of the vehicle. The window opening WO can be opened or closed by a regulator knob (not shown) or a regulator switch (not shown). An example of the apparatus that opens or closes the slide door D situated on a right side of the vehicle body B, which is a door provided on the side body in a rearward side of a driver's sheet in a right-hand drive vehicle, will be explained herein.

The fully closing latch unit CR holds the slide door D in a fully closed state relative to the vehicle body B. The fully closing latch unit CR includes a front fully closing latch unit CRF arranged between the vehicle body B and an edge of the slide door D on a vehicle front side, and a rear fully closing latch unit CRR arranged between the vehicle body B and an edge of the slide door D on a vehicle rear side. The front fully closing latch unit CRF and the rear fully closing latch unit CRR are same in a configuration as a conventional fully closing latch unit. For example, each of the front fully closing latch unit CRF and the rear fully closing latch unit CRR includes a latch to be engaged with a striker in the vehicle body B, and a ratchet that controls the latch.

The rear fully closing latch unit CRR includes a closer device CL. The closer device CL is an actuator that includes a clutch mechanism (not shown). When the latch is in a half latched state, the closer device CL functions to turn the latch into a fully latched state from the half latched state on condition that the clutch mechanism is connected. Even while turning to the fully latched state, the closer device CL discontinues turning once the clutch mechanism is disconnected.

The fully opening latch unit OR is arranged between the vehicle body B and a support frame SF that is arranged in the slide door D, and holds the slide door D in a fully opened state. The support frame SF is arranged at a lower end of the inner panel IP on the vehicle front side protruding toward a vehicle interior side. The support frame SF guides the slide door D when the slide door D slides relative to the vehicle body B. Similarly to the fully closing latch unit CR, the fully opening latch unit OR is same in configuration as a conventional fully opening latch unit. The fully opening latch unit OR includes, for example, a latch to be engaged with a striker on the vehicle body B, and a ratchet that controls the latch.

The control unit 100 releases engagement of the fully closing latch unit CR, when an outside knob OK or an inside knob IK in the slide door D is operated, by an operation caused following the operation of the outside knob OK or the inside knob IK.

An example of a configuration of the control unit 100 according to the present embodiment is shown in FIGS. 5 to 10. The control unit 100 is arranged at an upper portion on a surface of the inner panel IP on a vehicle interior side through a control base plate 101. An inside knob shaft 102 is arranged on the control base plate 101. The inside knob shaft 102 includes an inside knob lever 110, a first link lever 120, and a second link lever 130. A child lock lever 140 and a switch lever 150 are arranged on the control base plate 101 in such a manner that the child lock lever 140 and the switch lever 150 are situated around the inside knob shaft 102.

The inside knob shaft 102 includes a spline for attaching the inside knob IK at a tip. The inside knob shaft 102 is rotatably connected to the control base plate 101 through a proximal end while a tip end is directed toward the vehicle interior side. The inside knob IK is attached to the inside knob shaft 102, and is exposed on the vehicle interior side enabling to be operated by a passenger. In an explanation below, a position at which the inside knob IK is directed upward in a direction substantially perpendicular to the ground will be referred to as a neutral position of the inside knob shaft 102. The neutral position is indicated by a solid line in FIG. 5.

The inside knob lever 110 is arranged at the proximal end of the inside knob shaft 102 in such a manner that the inside knob lever 110 rotates integrally with the inside knob shaft 102 on a rear surface, which faces the vehicle exterior side, of the control base plate 101. The inside knob lever 110 includes a first link engagement unit 111, a second link engagement unit 112, a switch lever engagement unit 113, and a first wire cable slide connecting unit 114. The first link engagement unit 111 is arranged at a portion in the inside knob lever 110 that extends toward a vehicle front side when the inside knob shaft 102 is located at the neutral position. The inside knob lever 110 includes a bend so as to make the inside knob lever 110 extends upward in the direction substantially perpendicular to the ground, and then toward the vehicle interior side when the inside knob shaft 102 is located at the neutral position. The second link engagement unit 112 is arranged at a portion that extends toward the vehicle interior side. A tip end of the second link engagement unit 112 protrudes toward a front surface of the control base plate 101 through a notch in the control base plate 101. The switch lever engagement unit 113 is arranged at a portion of the inside knob lever 110 that extends substantially downward from the inside knob shaft 102 when the inside knob shaft 102 is located at the neutral position. The inside knob lever 110 also includes a bend so as to make the inside knob lever 110 extends from the inside knob shaft 102 toward a vehicle rear side and then protrudes toward the front surface of the control base plate 101 through a notch in the control base plate 101 when the inside knob shaft 102 is located at the neutral position. The first wire cable slide connecting unit 114 is arranged at a portion that protrudes toward the front surface of the control base plate 101. An end of a first wire cable WC1 is slidably connected to the first wire cable slide connecting unit 114 through an elongate hole at a portion that protrudes toward the front surface of the control base plate 101. A knob return spring 103, not shown, is provided between the second link engagement unit 112 and the control base plate 101 for locating the inside knob shaft 102 at the neutral position.

The first link lever 120 is arranged between the control base plate 101 and the inside knob lever 110 in such a manner that the first link lever 120 is rotatable around the inside knob shaft 102. The first link lever 120 includes a first spring engagement unit 121, a first pin slide unit 122, and a first rod slide connecting unit 123. The first link lever 120 includes a bend so as to make the first link lever 120 extend from the inside knob shaft 102 along the second link engagement unit 112 and then toward the vehicle interior side. The first spring engagement unit 121 is arranged at a portion that extends toward the vehicle interior side. An end of the first spring engagement unit 121 is engaged with the knob return spring 103 to elastically deform the knob return spring 103 when the first link lever 120 rotates around the inside knob shaft 102. The first pin slide unit 122 is arranged at a portion in the first link lever 120 that extends along the first link engagement unit 111. A first slide groove 122*a* is formed in the first pin slide shaft 122 in such a manner that the first slide groove 122*a* extends in a radial direction of a core of the inside knob shaft 102, and a first engagement pin 124 is slidably arranged in the first slide groove 122*a*. The first rod slide connecting unit 123 is arranged at a portion in the first link lever 120 that extends downward from the inside knob shaft 102 toward the vehicle rear side. An end of a first connecting rod R1 is connected to an end of the first rod slide connecting unit 123 through an elongate hole.

The second link lever 130 is arranged on the front surface of the control base plate 101 in such a manner that the second link lever 130 is rotatable around the inside knob shaft 102. The second link lever 130 includes a knob lever engagement unit 131 and a second rod slide connecting unit 132. The knob lever engagement unit 131 is arranged at a portion of the second link lever 130 that extends from the inside knob shaft 102 along the second link engagement unit 112. The knob lever engagement unit 131 includes an engagement hole 133 and a first door operation detection unit 134. The engagement hole 133 is an opening through which the end of the second link engagement unit 112 is engaged. The first door operation detection unit 134 is arranged at a portion of the second link lever 130 that extends from an end of the knob lever engagement unit 131 toward the vehicle rear side. When the inside knob shaft 102 is at the neutral position, the first door operation detection unit 134 is not in contact with a first door operation detection sensor S1 on the control base plate 101. Only when the second link lever 130 rotates counterclockwise in FIG. 2, the first door operation detection unit 134 comes in contact with the first door operation detection sensor S1 to turn on the first door operation detection sensor S1. The second rod slide connecting unit 132 is arranged at a portion of the second link lever 130 that extends from the inside knob shaft 102 substantially along the first rod slide connecting unit 123. An end of a second connecting rod R2 is connected to the second rod slide connecting unit 132 through an elongate hole.

The switch lever 150 is rotatably arranged, through a switch lever shaft 151, on the front surface of the control base plate 101 at a portion below the inside knob shaft 102. The switch lever 150 includes a second pin slide unit 152, a second spring engagement unit 153, and a second door operation detection unit 154. The second pin slide unit 152 is arranged at a portion of the switch lever 150 that has a length reaching a rotational movement area of the switch lever engagement unit 113 when the second pin slide unit 152 extends from a switch lever shaft 151 toward the inside knob shaft 102. A second slide groove 152*a* is formed in the second pin slide unit 152 in such a manner that to the second slide groove 152*a* extends in a radial direction of the switch lever shaft 151, and a second engagement pin 155 is slidably arranged in the second slide groove 152*a*. The second engagement pin 155 protrudes toward the rear surface of the control base plate 101 through a notch formed in the control base plate 101. The second spring engagement unit 153 is arranged at a portion that extends from the switch lever shaft 151 in a direction opposite to the second pin slide unit 152. A second return spring 156 is arranged between the second sprint engagement unit 153 and the control base plate 101. The second return spring 156 presses the second pin slide unit 152 against a protrusion 101*a* on the control base plate 101 by rotating the switch lever 150 clockwise in FIG. 2 so as to always direct a tip of the second pin slide unit 152 toward the inside knob shaft 102. The second door operation detection unit 154 is arranged at a portion of the switch lever 150 that extends from a portion between the second pin slide unit 152 and the second spring engagement unit 153. When the second pin slide unit 152 is abutted on the protrusion 101*a*, the second door operation unit 154 is not in contact with a second door operation detection sensor S2 that is arranged on the control base plate 101. Only when the switch lever 150 rotates counterclockwise in FIG. 2, the second door operation unit 154 comes in contact with the second door operation detection senor S2 to turn on the second door operation detection sensor S2.

The child lock lever 140 is rotatably arranged, through a child lock lever shaft 141, on the rear surface of the control base plate 101 at a portion on a vehicle front side of the switch lever 150. The child lock lever 140 includes a first pin operation unit 142, a second pin operation unit 143, and a switch operation unit 144. The first pin operation unit 142 is arranged at a portion that extends from the child lock lever shaft 141 in a direction in which the first pin operation unit 142 crosses the first pin slide unit 122. A positioning unit 145 and a first pin operation groove 146 are formed on the first pin operation unit 142. The positioning unit 145 is an elastic piece that is arranged at a proximal end of the first pin operation unit 142.

The positioning unit 145 is abutted on and engaged with a positioning protrusion 101*b* that is formed on the control base plate 101, thereby specifying a position of the child lock lever 140 to one of an unlock position and a lock position. The first pin operation groove 146 extends in a longitudinal direction of the first pin operation unit 142, and is slidably engaged with the first engagement pin 124 in the first link lever 120 through its inner peripheral surface. The second pin operation unit 143 is arranged at a portion of the child lock lever 140 that extends from the child lock lever shaft 141 in a direction in which the second pin operation unit 143 crosses the second pin slide unit 152 in the switch lever 150. A second operation groove 147 is provided in the second pin operation unit 143. The second operation groove 147 extends substantially in a longitudinal direction of the vehicle, and is slidably engaged with the second engagement pin 155 in the switch lever 150 through its inner peripheral surface. The switch operation unit 144 is to switch the child lock lever 140, and extends from the child lock lever shaft 141 toward the vehicle front side.

The child lock lever 140 functions to locate the first engagement pin 124 in an area in which the first link engagement unit 111 makes rotational movement. The child lock lever 140 also functions to locate the second engagement pin 155 outside of an area in which the switch lever engagement unit 113 makes rotational movement in the second pin slide unit 152 of the switch lever 150. When the child lock lever 140 is in the lock position, the first engagement pin 124 is located outside of the area in which the first link engagement unit 111 makes the rotational movement. In addition, the second engagement pin 155 is located in the area in which the inside knob lever 110 makes the rotational movement.

The control unit 100 further includes an open lever 160, an open sub-lever 170, a fail-safe lever 180, and a lock unit 190 on the control base plate 101 at a portion on the vehicle rear side relative to the inside knob shaft 102. The open lever 160, the open sub-lever 170, and the fail-safe lever 180 are arranged on the control base plate 101 through a lever shaft 104 that is common for the open lever 160, the open sub-lever 170, and the fail-safe lever 180, and are individually rotatable around a core of the lever shaft 104.

The open lever 160 is arranged on the front surface of the control base plate 101, and includes a sub-lever engagement unit 161 and a wire cable connecting unit 162. The sub-lever engagement unit 161 is arranged at a portion of the open lever 160 that extends upward from the lever shaft 104, and includes a lock pin slide groove 163 and an engagement convex portion 164. The lock pin slide groove 163 is formed in a substantially straight line along a direction in which the sub-lever engagement unit 161 extends. The engagement convex portion 164 is arranged at a portion that is bent to extend from a tip end of the sub-lever engagement unit 161 toward the control base plate 101. The engagement convex portion 164 protrudes toward the rear surface of the control base plate 101 through a notch formed in the control base plate 101. The wire cable connecting unit 162 is arranged at a portion that extends from the lever shaft 104 in a direction opposite to the sub-lever engagement unit 161. An end of a second wire cable WC2 and an end of a third wire cable WC3 are connected to the wire cable connecting unit 162. Another end of the second wire cable WC2 is connected to the front fully closing latch unit CRF. Thus, the second wire cable WC2 enables a cancel operation for the front fully closing latch unit CRF when the second wire cable WC2 is pulled. Another end of the third wire cable WC3 is connected to the rear fully closing latch unit CRR. Thus, the third wire cable WC3 enables a cancel operation for the rear fully closing latch unit CRR when the third wire cable WC3 is pulled.

The open sub-lever 170 is arranged on the rear surface of the control base plate 101, and includes an open lever engagement unit 171, a fourth wire cable slide connecting unit 172, a first rod connecting unit 173, and a lock pin engagement unit 174. The open lever engagement unit 171 is arranged at a portion of the open sub-lever 170 that extends upward from the lever shaft 104, and is abutted on and engaged with the engagement convex portion 164 in the open lever 160. The open lever engagement unit 171 includes a third door operation detection unit 175. The third door operation detection unit 175 protrudes toward the front surface of the control base plate 101 through a notch formed in the control base plate 101. The third door operation detection unit 175 is detached from a third door operation sensor S3 that is arranged on the control base plate 101 when the engagement convex portion 164 is abutted on an end of the notch on a vehicle front side and the open lever engagement unit 171 is abutted on the engagement convex portion 164. Only when the open sub-lever 170 rotates clockwise in FIG. 2, the third door operation detection unit 175 comes in contact with the third door operation detection sensor S3 to turn on the third door operation detection sensor S3. The open sub-lever 170 includes a bend so as to make the open sub-lever 170 extend upward from the lever shaft 104 toward the vehicle rear side, and then upward around the lever shaft 104. The fourth wire cable slide connecting unit 172 is arranged at a portion that extends upward around the lever shaft 104. An end of the fourth wire cable WC4 is slidably connected to the fourth wire cable slide connecting unit 172 through an elongate hole. The open sub-lever 170 includes another bend so as to make the open sub-lever 170 extend from the lever shaft 104 in a direction opposite to the open lever engagement unit 171, and then in a direction toward the vehicle rear side. The first rod connecting unit 173 is arranged at a portion that extends toward the vehicle rear side. Another end of the first connecting rod R1 is connected to a tip of the first rod connecting unit 173. The lock pin engagement unit 174 is arranged at a portion of the open sub-lever 170 that extends along the sub-lever engagement unit 161 while securing the engagement convex portion 176 equal in width to the lock pin slid groove 163 between the lock pin engagement unit 174 and the open lever engagement unit 171 when the open lever engagement unit 171 is abutted on and engaged with the sub-lever engagement unit 161 through the engagement convex portion 164. The lock pin engagement unit 174 is sufficiently shorter than the lock pin slide groove 163, and is substantially equal in length to a width of the lock pin slide groove 163.

The fail-safe lever 180 is arranged on the front surface of the control base plate 101 at a portion on the vehicle interior side relative to the open lever 160. The fail-safe lever 180 includes a sub-lever pressing unit 181, a second rod connecting unit 182, and a fifth wire cable connecting unit 183. The fail-safe lever 180 includes a bend so as to make the fail-safe lever 180 extend from the lever shaft 104 toward the vehicle rear side, and then extend toward the control base plate 101. The sub-lever pressing unit 181 is arranged at a portion that extends toward the control base plate 101. The sub-lever pressing unit 181 protrudes toward the rear surface of the control base plate 101 through a notch formed in the control base plate 101. The sub-lever pressing unit 181 is pushed in a direction such that the sub-lever pressing unit 181 always rotates counterclockwise in FIG. 2 by an elastic force of a coil spring 184 that is arranged between the sub-lever pressing unit 181 and the control base plate 101. By pressing and abutting the sub-lever pressing unit 181 against the open sub-lever 170, the sub-lever pressing unit 181 pushes the open sub-lever 170 and the open lever 160 in a counterclockwise direction. The second rod connecting unit 182 and the fifth wire cable connecting unit 183 are arranged at a portion that extends from the lever shaft 104 along the wire cable connecting unit 162 of the open lever 160. The second rod connecting unit 182 is formed on a proximal end of the fail-safe lever 180 proximate to the lever shaft 104, and the fifth wire cable connecting unit 183 is formed at a tip end of the fail-safe lever 180. Another end of the second connecting rod R2 is connected to the second rod connecting unit 182, and an end of a fifth wire cable WC5 is connected to the fifth wire cable connecting unit 183. Another end of the fifth wire cable WC5 is connected to the closer device CL in the rear fully closing latch unit CRR. Thus, the clutch mechanism of the closer device CL is switched from a connected state to a disconnected state when the cable WC5 is pulled.

The lock unit 190 includes a locking lever 191 and a locking actuator LA. The locking lever 191 is rotatably arranged, through a lock lever shaft 192, on the front surface of the control base plate 101 at a portion on the vehicle rear side relative to the lever shaft 104. The locking lever 191 includes a lock pin holding unit 193 and an actuator engagement unit 194. The lock pin holding unit 193 is arranged at a portion that extends from the lock lever shaft 192 toward the vehicle rear side. A lock member 195 is formed in the lock pin holding unit 193 at its extended end. The lock member 195 is rotatably supported by the lock pin holding unit 193 through its proximal end, and includes a lock pin 196 at a tip end of the lock member 195. The lock pin 196 is cylindrical and protrudes from the tip end of the lock member 195 toward the control base plate 101. An end of the lock pin 196 penetrates through the lock pin slide groove 163 and the notch formed in the control base plate 101 to be engaged with an engagement concave portion 176 formed between the open lever engagement unit 171 of the open sub-lever 170 and the lock pin engagement unit 174. The actuator engagement unit 194 is arranged at a portion that extends from the lock lever shaft 192 toward the vehicle rear side, and that has a tip end branched into two units. The locking actuator LA is arranged at a portion that is situated closest to the rear of the vehicle in the control base plate 101. The locking actuator LA includes a locking output lever RL at a portion on the vehicle front side. The locking output lever RL is vertically rocked along the front surface of the control base plate 101, and an engagement protrusion RLa that is formed at a tip end of the locking output lever RL is engaged with a branch unit of the actuator engagement unit 194. The locking actuator LA moves the lock pin holding unit 193 downward through the actuator engagement unit 194 and locates the lock pin 196 in an area in which the lock pin engagement unit 174 makes rotational movement in the lock pin slide groove 163 of the open lever 160, thereby unlocking the open lever 160 when the locking output lever RL is rocked most upward. The locking actuator LA moves the lock pin holing unit 193 upward through the actuator engagement unit 194 and locates the lock pin 196 outside of the area in which the lock pin engagement unit 174 makes the rotational movement in the lock pin slide groove 163, thereby locking the open lever 160 when the locking output lever RL is rocked most downward. In the lock unit 190 in the present embodiment, a locking rod LD is connected to an inside lock button SN, and the inside lock button SN is connected to the locking output lever RL through the locking rod LD. When the inside lock button SN is operated, an operation force of the button SN is transmitted to the locking lever 191 through the locking output lever RL. By rotating the locking lever 191, the lock unit 190 can be appropriately switched over between the locked state and the unlocked state.

FIGS. 11 to 18 are conceptual views of the control unit 100 when the control unit 100 operates. Operations of the control unit 100 will be explained with reference to FIGS. 11 to 18 as well as FIGS. 5 to 7 that depict an initial state of the control unit 100.

Figure 5:
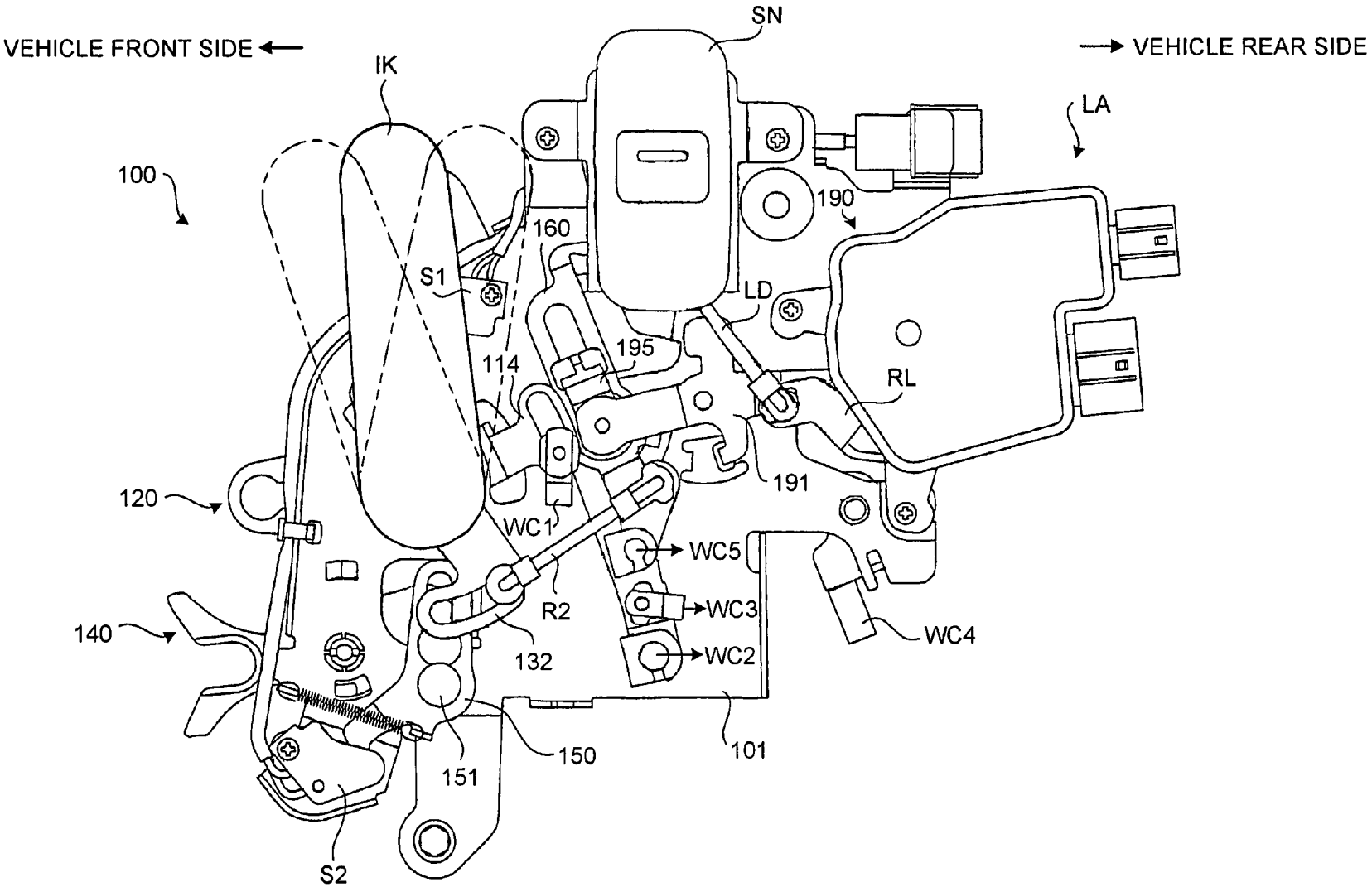
FIG. 5 is a side view of a control unit in the apparatus shown in FIG. 1 viewed from an interior side of the four-wheel vehicle.
Figure 6:
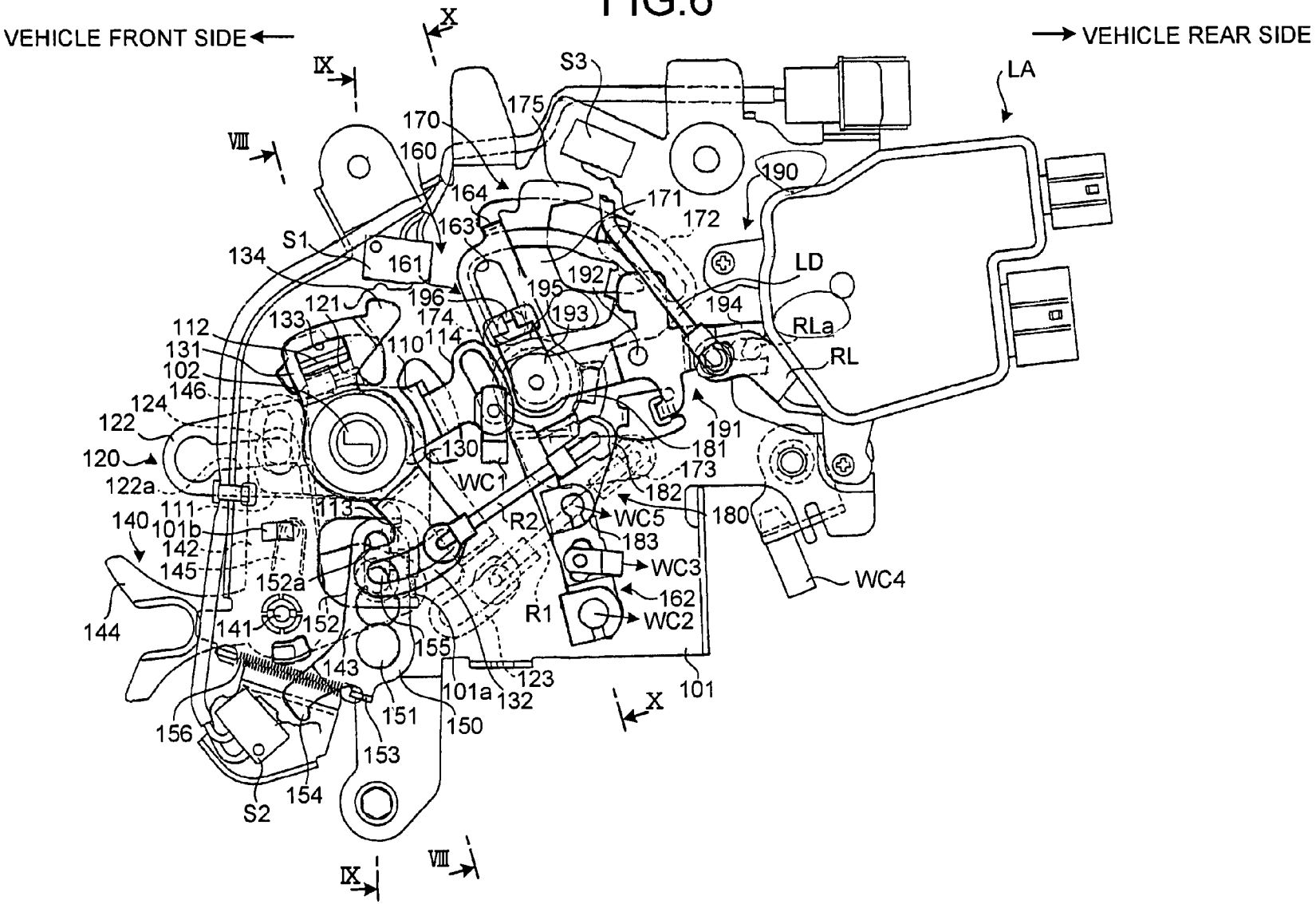
FIG. 6 is a detailed side view of the control unit in FIG. 5 viewed from the interior side.
Figure 7:
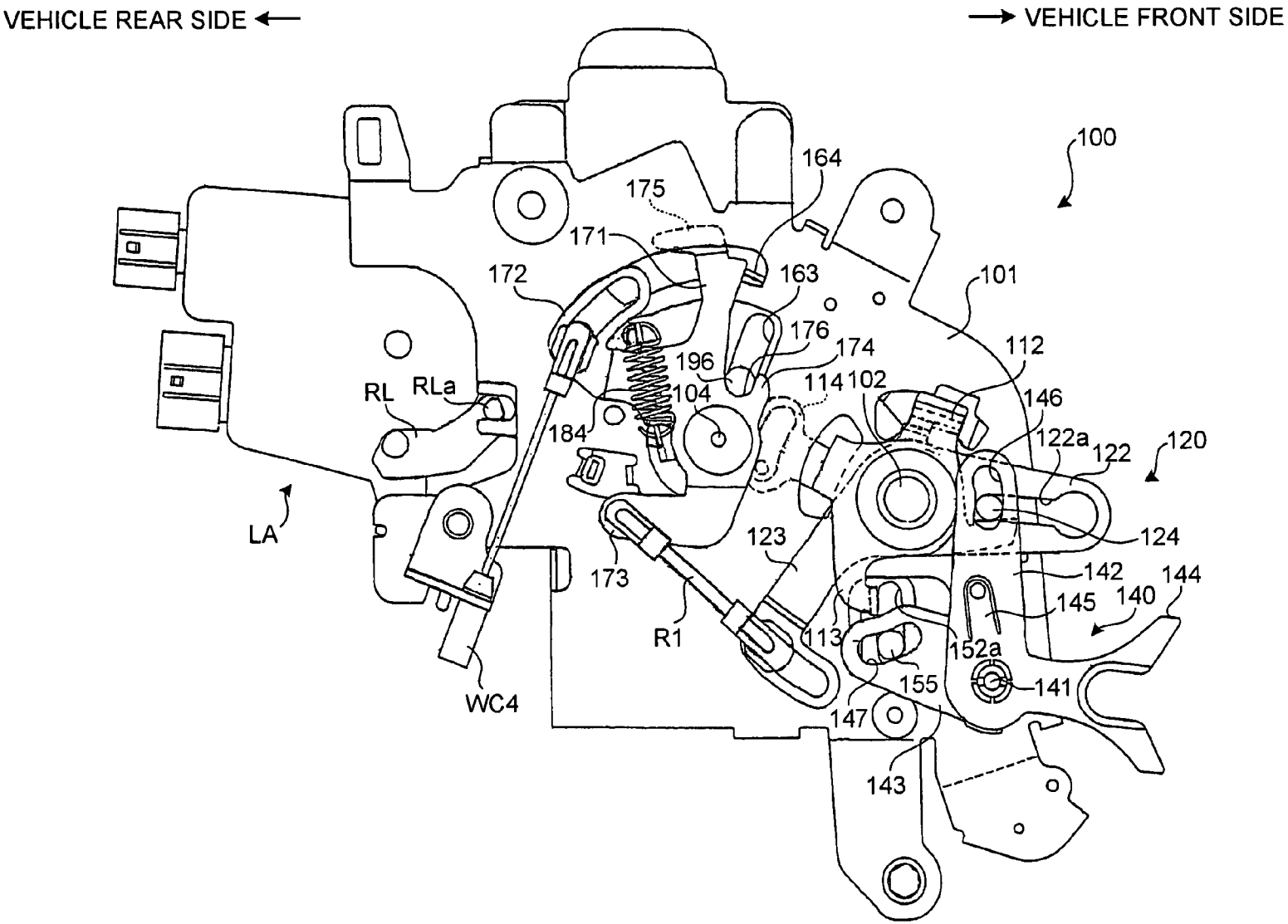
FIG. 7 is a detailed side view of the control unit in FIG. 5 viewed from an exterior side of the four-wheel vehicle.
Figure 8:
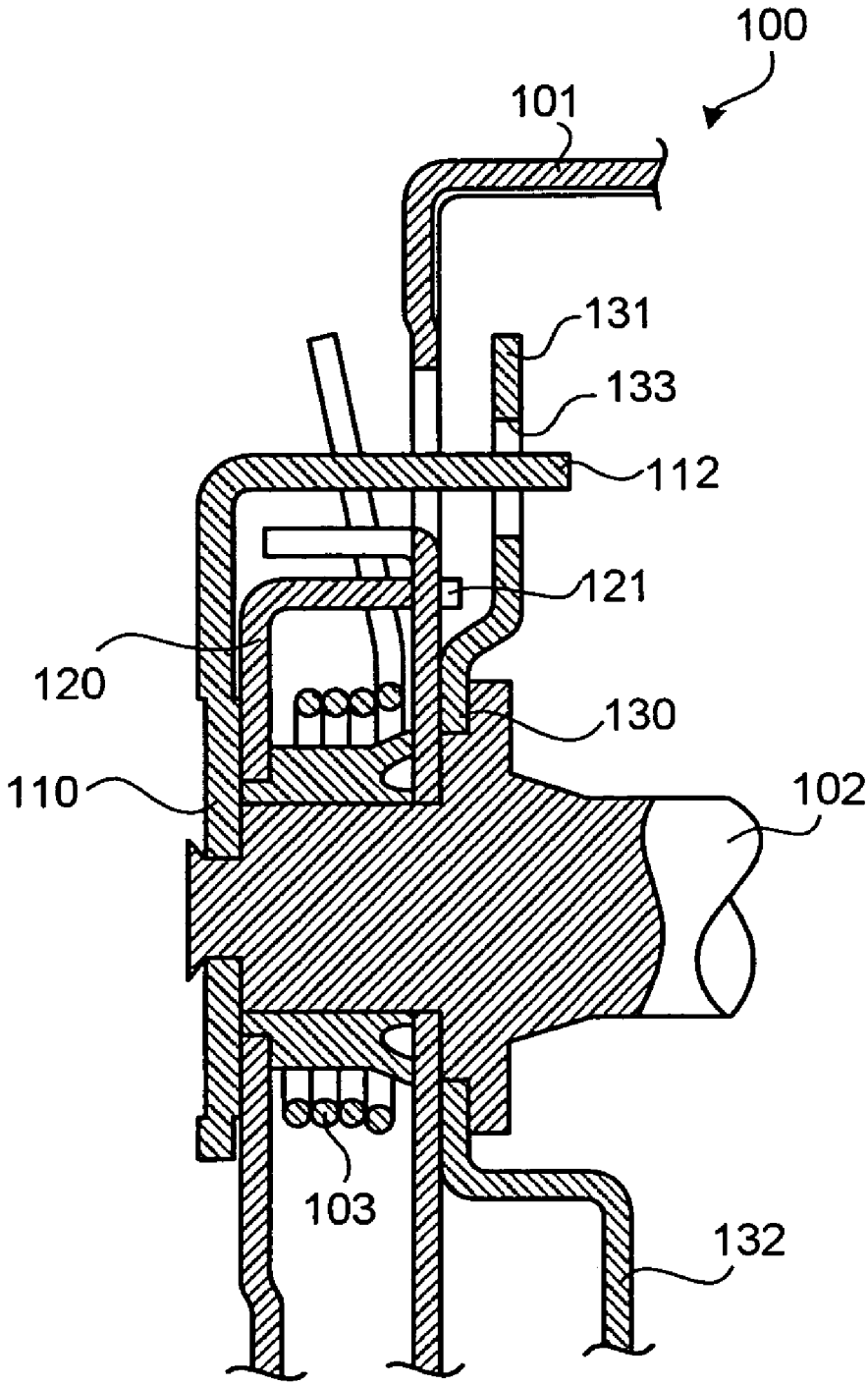
FIG. 8 is a cross-section of the control unit taken along a line VIII-VIII in FIG. 6.
Figure 9:
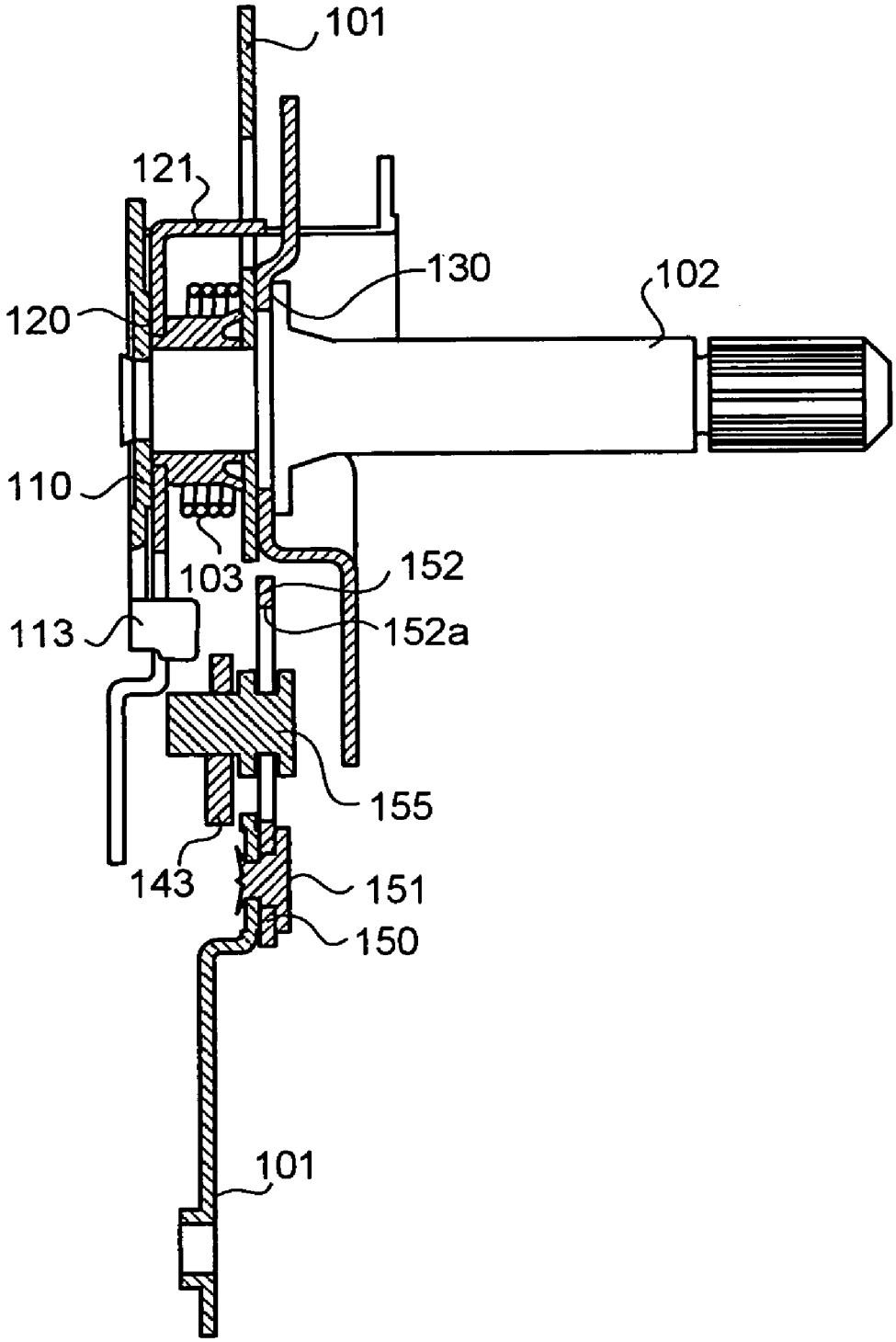
FIG. 9 is a cross-section of the control unit taken along a line IX-IX in FIG. 6.
Figure 10:
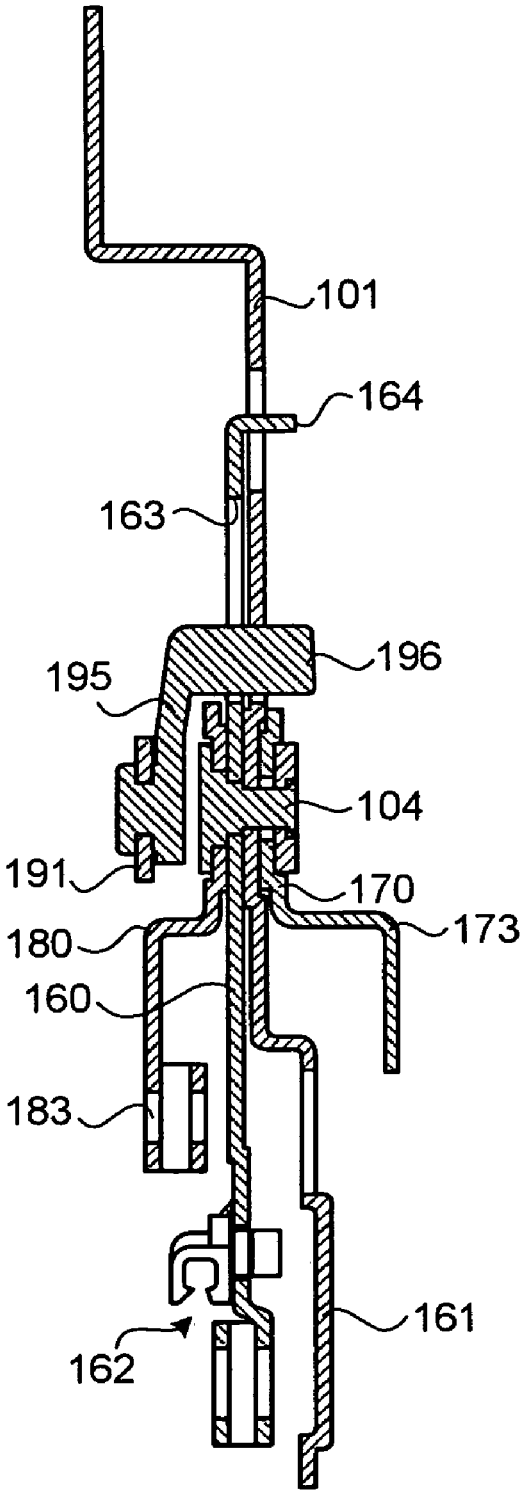
FIG. 10 is a cross-section of the control unit taken along a line X-X in FIG. 6.

In an initial state of the control unit 100, a tip of the inside knob IK is directed upward in a direction substantially vertical, as indicated by the solid line in FIG. 5, by an action of the knob return spring 103. In the initial state shown in FIGS. 5 to 7, the child lock lever 140 is in the unlock position and the lock unit 190 is unlocked.

Figure 11:
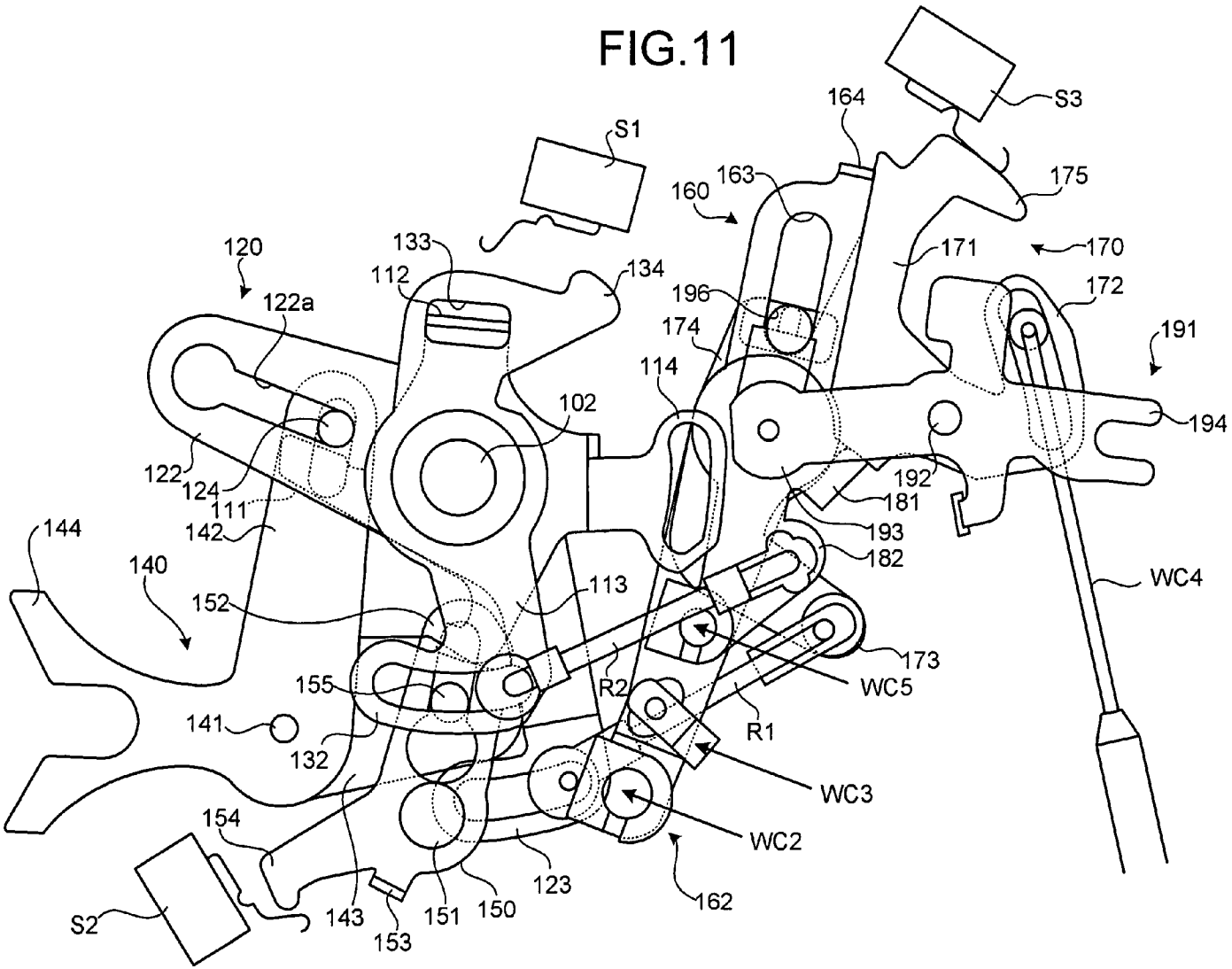
FIG. 11 is a conceptual view of the control unit shown in FIG. 5 when an inside knob is operated to open a door.

When the inside knob IK is rocked toward the vehicle rear side against the elastic force of the knob return spring 103 from this initial state (a door opening operation of the inside knob IK), the inside knob shaft 102 rotates clockwise in FIGS. 11 to 18. When the inside knob shaft 102 rotates clockwise, the inside knob lever 110 rotates clockwise as shown in FIG. 11. The rotation of the inside knob lever 110 is transmitted to the first link lever 120 through the first link engagement unit 111 and the first engagement pin 14, and transmitted to the second link lever 130 through the second link engagement unit 112 and the engagement hole 133. As a result, the first link lever 120 and the second link lever 130 also rotate clockwise.

When the first link lever 120 rotates, the open sub-lever 170 is rotated clockwise through the first connecting rod R1. Furthermore, the rotation of the open sub-lever 170 is transmitted to the open lever 160 through the lock pin engagement unit 174 and the lock pin 196, whereby the second wire cable WC2 and the third wire cable WC3 are pulled, and the cancel operations for the front fully closing latch unit CRF and the rear fully closing latch unit CRR are performed. Therefore, for example, even if the slide door D is fully closed, the slide door D can be opened and moved by rocking the inside knob IK toward the vehicle rear side. Since the rotation of the open sub-lever 170 following the rotation of the first link lever 120 enables the first door operation detection unit 175 to turn on the third door operation detection sensor S3, it is possible to detect that the inside knob IK is rocked based on a detection result of the third door operation detection sensor S3.

Furthermore, when the second link lever 130 rotates following the rotation of the first link lever 120, the fail-safe lever 180 then rotates clockwise through the second connecting rod R2, thereby pulling the fifth wire cable WC5 to disconnect the clutch mechanism of the closer device CL. Therefore, for example, even if the closer device CL is in operation, the operation for switching from the half latched state to the fully latched state can be discontinued just by rocking the inside knob IK toward the vehicle rear side.

Figure 12:
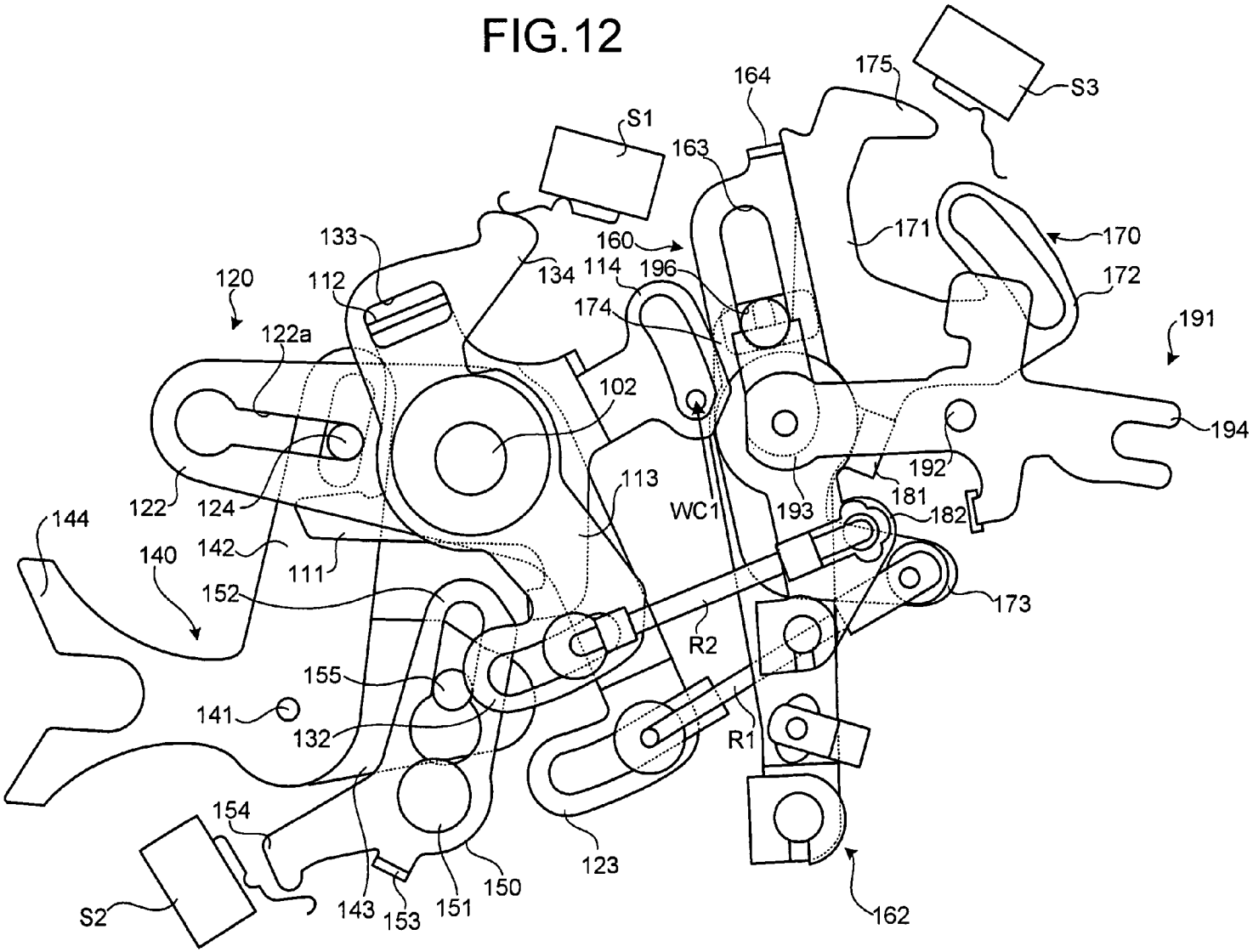
FIG. 12 is a conceptual view of the control unit shown in FIG. 5 when the inside knob is operated to close the door.

When the inside knob IK is rocked toward the vehicle front side against the elastic force of the knob return spring 103 from the initial state (a door closing operation of the inside knob IK), the inside knob shaft 102 rotates counterclockwise. When the inside knob shaft 102 rotates counterclockwise, the inside knob lever 110 rotates counterclockwise as shown in FIG. 12. The rotation of the inside knob lever 110 is transmitted to the second link lever 130 through the second link engagement unit 112 and the engagement hole 133, whereby the second link lever 130 rotates counterclockwise. When the second link lever 130 rotates, the first wire cable WC1 is pulled. Because one end of the second connecting rod R2 is appropriately moved within the elongate hole in the second link lever 130 at this time, counterclockwise rotation of the second link lever 130 does not make the fail-safe lever 180 operate. The rotation of the second link lever 130 enables the first door operation detection unit 134 to turn on the first door operation detection sensor S1. Therefore, it is possible to detect that the inside knob IK is rocked toward the vehicle front side based on a detection result of the first door operation detection sensor S1.

Figure 13:
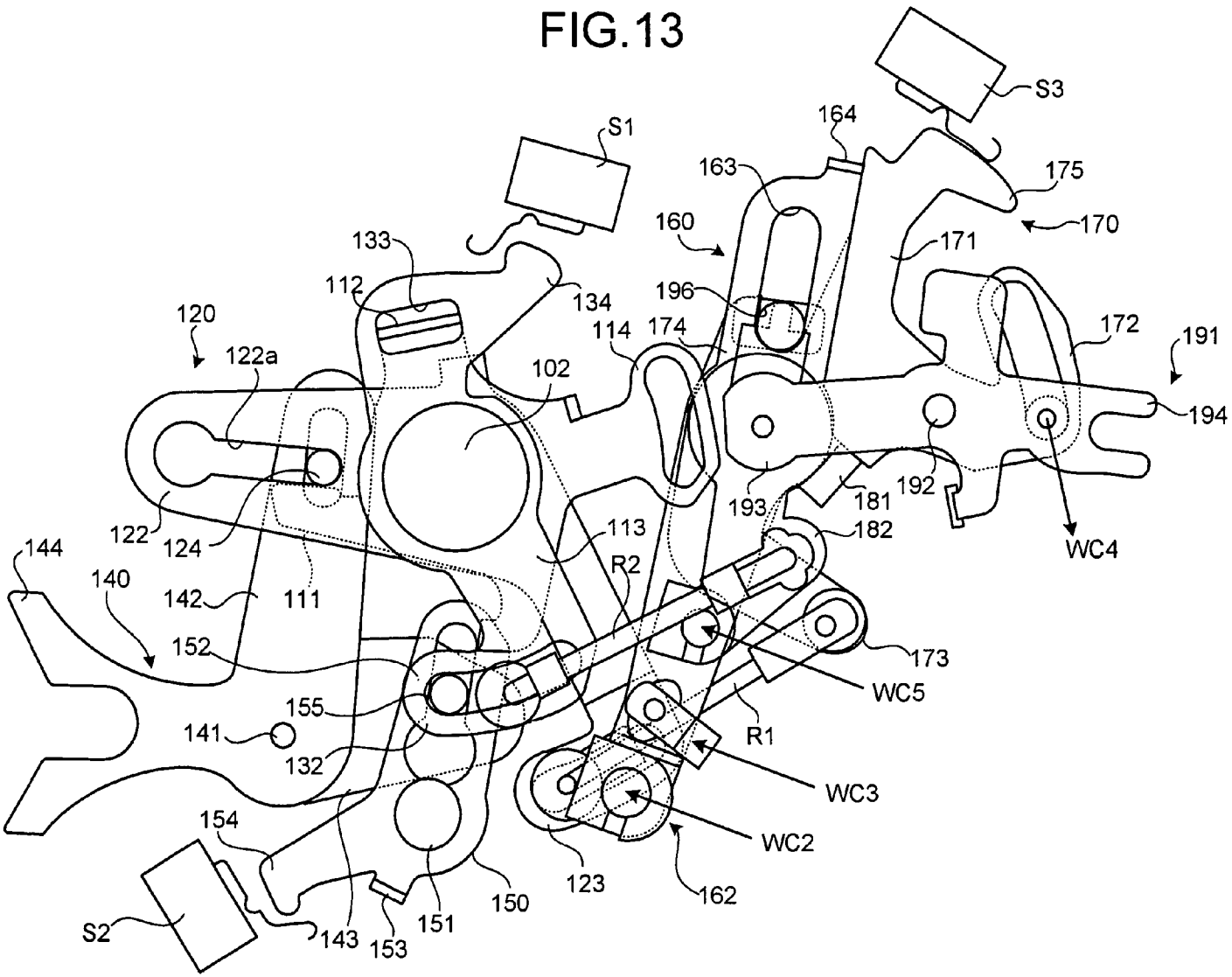
FIG. 13 is a conceptual view of the control unit shown in FIG. 5 when an outside knob is operated.

When the fourth wire cable WC4 is pulled from the initial state, the open sub-lever 170 rotates clockwise as shown in FIG. 13. The rotation of the open sub-lever 170 is transmitted to the open lever 160 through the lock pin engagement unit 174 and the lock pin 196, whereby the second wire cable WC2 and the third wire cable WC3 are pulled, and cancel operation for the front fully closing latch unit CRF and the rear fully closing latch unit CRR are performed. Therefore, for example, even if the slide door D is fully closed, the slide door D can be opened and moved by pulling the fourth wire cable WC4. Because one end of the first connecting rod R1 is appropriately moved within the elongate hole of the first link lever 120 at this time, the clockwise rotation of the open sub lever 170 does not make the first link lever 120 operate. The rotation of the open sub-lever 170 enables the third door operation detection unit 175 to turn on the third door operation detection sensor S3. Therefore, it is possible to detect that the fourth wire cable WC4 is pulled based on a detection result of the third door operation detection sensor S3.

Furthermore, when the open sub-lever 170 rotates, the fail-safe lever 180 is rotated clockwise through the sub-lever pressing unit 181, thereby pulling the fifth wire cable WC5 to disconnect the clutch mechanism of the closer device CL. Therefore, for example, even if the closer device CL is in operation, the switching operation from the half latched state to the fully latched state can be discontinued by pulling the fourth wire cable WC4. Because one end of the second connecting rod R2 is appropriately moved within the elongate hole of the second link lever 130 at this time, the clockwise rotation of the fail-safe lever 180 does not make the second link lever 130 operate.

Figure 14:
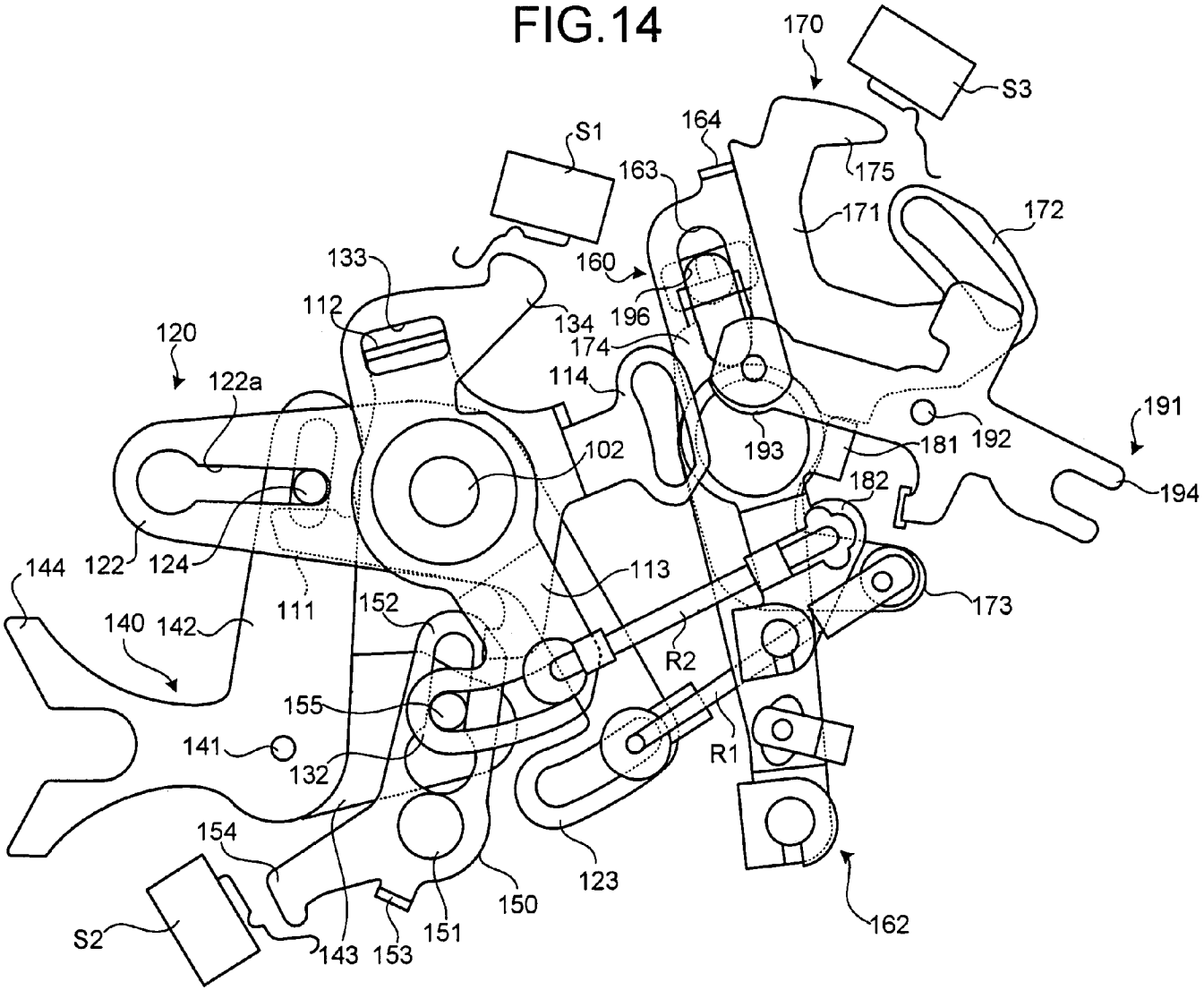
FIG. 14 is a conceptual view of the control unit shown in FIG. 5 in a locked state.
Figure 15:
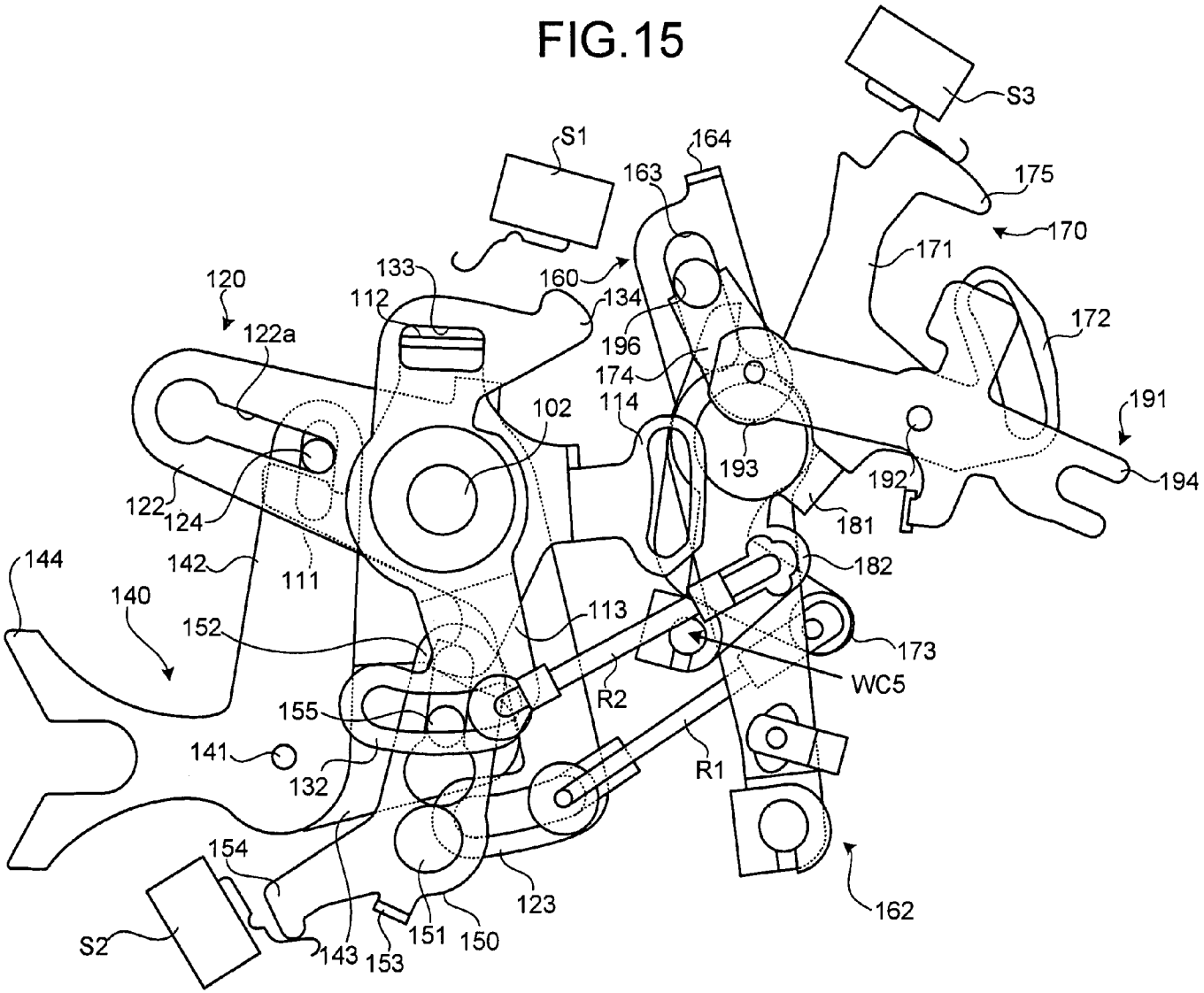
FIG. 15 is a conceptual view of the control unit shown in FIG. 5 when the inside knob is operated to open the door in the locked state.

When the lock unit 190 is switched to the locked state from the initial state, the lock pin 196 is located outside of the area in which the lock engagement unit 174 makes rotational movement as shown in FIG. 14. Accordingly, even if the inside knob IK is rocked toward the vehicle rear side from the locked state, the rotation transmitted to the open sub-lever 170 through the first link lever 120 and the first connecting rod R1 is not transmitted to the open lever 160. Therefore, the cancel operations for the front fully closing latch unit CRF and the rear fully closing latch unit CRR is not to be performed. However, even if the lock unit 190 is in the locked state, the rotation of the open sub-lever 170 following the rotation of the first link lever 120 enables the third door operation detection unit 175 to turn on the third door operation detection sensor S3. Therefore, the rocking of the inside knob IK toward the vehicle rear side can be detected based on the detection result of the third door operation detection sensor S3. In addition, the second link lever 130 rotates following the rocking of the inside knob IK toward the vehicle rear side. Therefore, the fail-safe lever 180 rotates clockwise through the second connecting rod R2, whereby the fifth wire cable WC5 is pulled, and the clutch mechanism of the closer device CL is disconnected. Consequently, even in the locked state, the switching operation from the half latched state to the fully latched state can be discontinued by rocking the inside knob IK toward the vehicle rear side.

Figure 16:
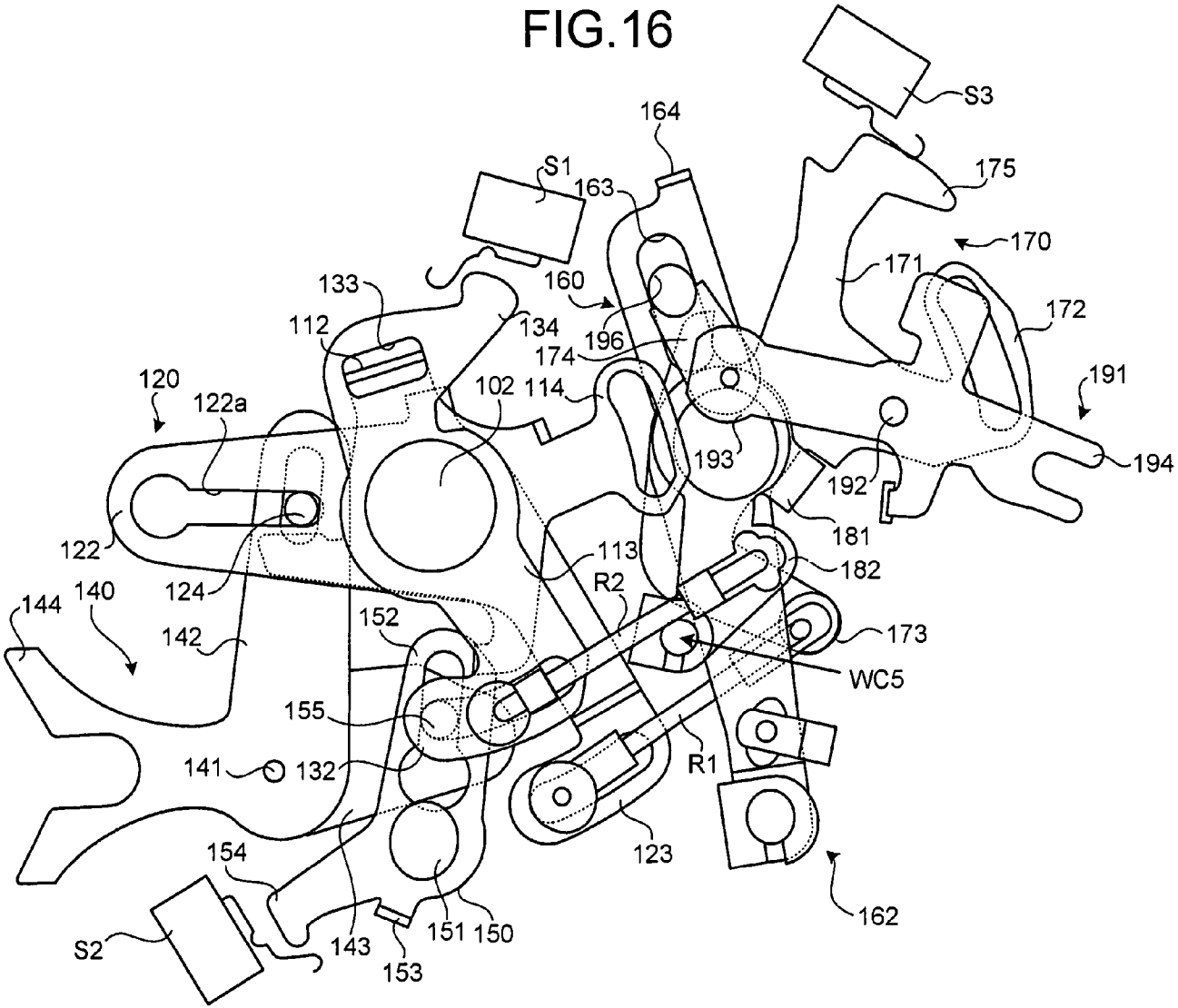
FIG. 16 is a conceptual view of the control unit shown in FIG. 5 when the outside knob is operated is in the locked state.

Moreover, even if the fourth wire cable WC4 is pulled from the locked state, the rotation of the open sub-lever 170 is not transmitted to the open lever 160 as shown in FIG. 16. Therefore, the cancel operations for the front fully closing latch unit CRF and the rear fully closing latch unit CRR are not performed. However, even in the locked state, the rotation of the open sub-lever 170 following the rotation of the first link lever 120 enables the third door operation detection unit 175 to turn on the third door operation detection sensor S3. Therefore, it is possible to detect that the fourth wire cable WC4 is pulled based on the detection result of the third door operation detection sensor S3. In addition, the fail-safe lever 180 rotates clockwise by the rotation of the open sub-lever 170, whereby the fifth wire cable WC5 is pulled and the clutch mechanism of the closer device CL is disconnected. Accordingly, even in the locked state, the switching operation from the half latched state to the fully latched state can be discontinued by pulling the fourth wire cable WC4.

Figure 17:
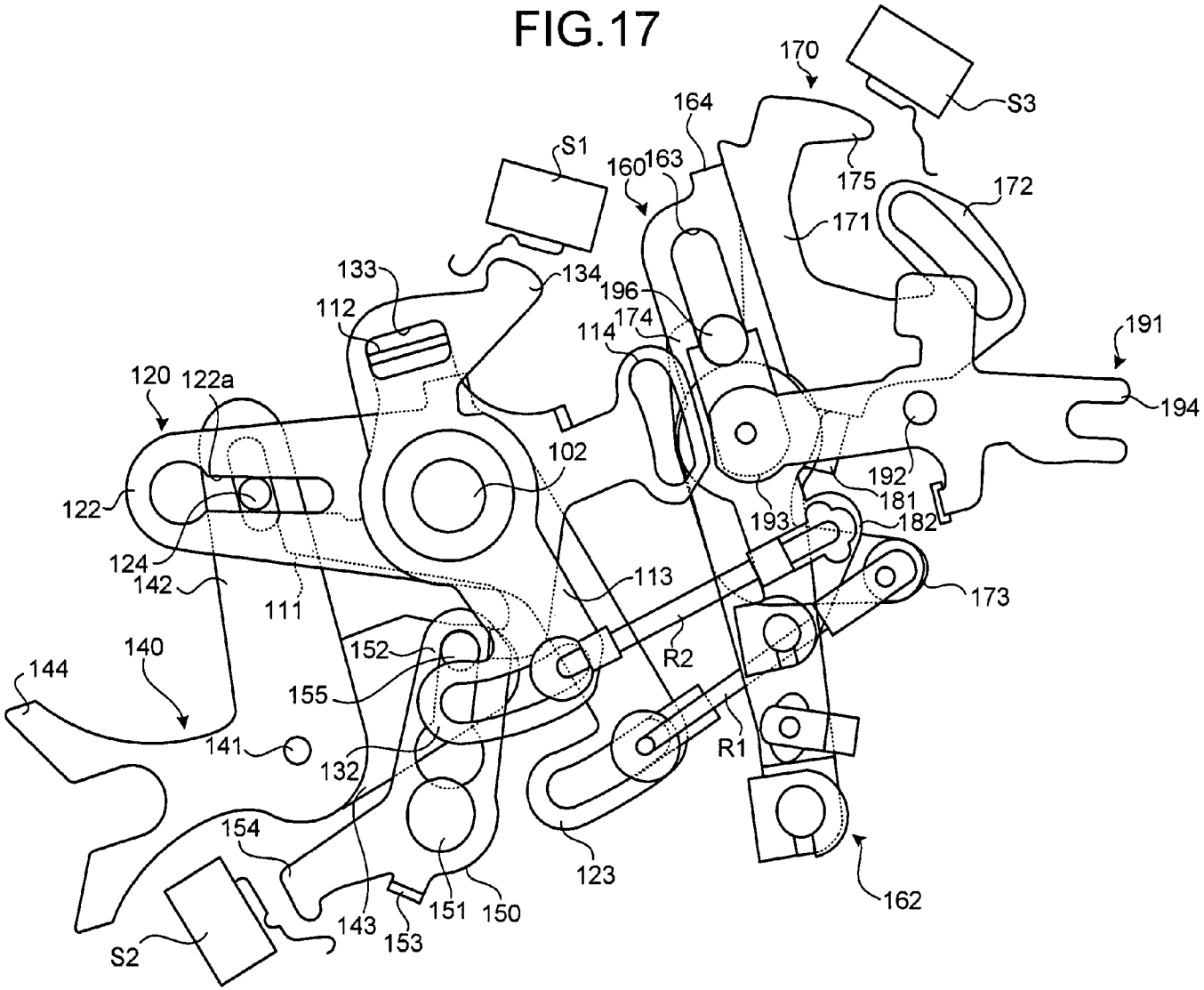
FIG. 17 is a conceptual view of the control unit shown in FIG. 5 in a child lock state.
Figure 18:
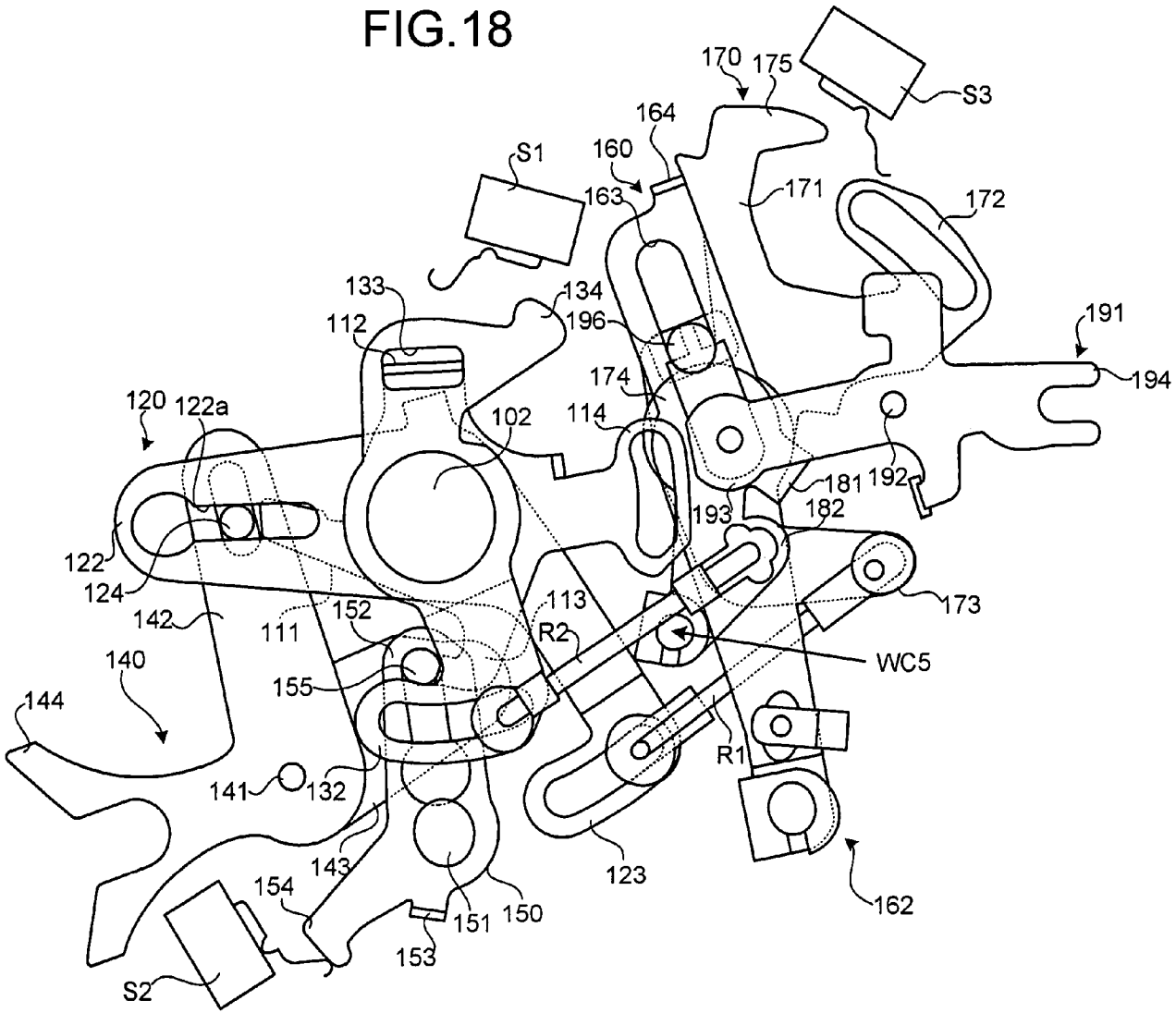
FIG. 18 is a conceptual view the control unit shown in FIG. 5 when the inside knob is operated to open the door in the child lock state.

When the child lock lever 140 is switched to the lock position from the initial state, the first engagement pin 124 on the first pin slide unit 122 of the first link lever 120 is located outside of the area in which the first link engagement unit 111 makes the rotational movement as shown in FIG. 17. Therefore, even if the inside knob IK is rocked toward the vehicle rear side from this state, the rotation of the inside knob lever 120 is not transmitted to the first link lever 120 as shown in FIG. 18. Therefore, the cancel operations for the front fully closing clutch unit CRF and the rear fully closing clutch unit CRR is not performed. However, when the child lock lever 140 is at the lock position, the second engagement pin 155 on the second pin slide unit 152 of the switch lever 150 is located in the area in which the switch lever engagement unit 113 makes the rotational movement. Therefore, the clockwise rotation of the inside knob lever 110 is transmitted to the switch lever 150 through the switch lever engagement unit 113 and the second engagement pin 155. In addition, the switch lever 150 rotates counterclockwise, thereby turning on the second door operation detection sensor S2. Therefore, it is possible to detect that the inside knob IK is rocked toward the vehicle rear side based on the detection result of the second door operation detection sensor S2. Furthermore, the second link lever 130 is rotated by the rocking of the inside knob IK toward the vehicle rear side. As a result, the fail-safe lever 180 is rotated clockwise through the second connecting rod R2, thereby pulling the fifth wire cable WC5 to disconnect the clutch mechanism of the closer device CL. Consequently, even if the child lock lever 140 is in the lock position, the switching operation from the half latched state to the fully latched state can be discontinued by rocking the inside knob IK toward the vehicle rear side.

Figure 19:
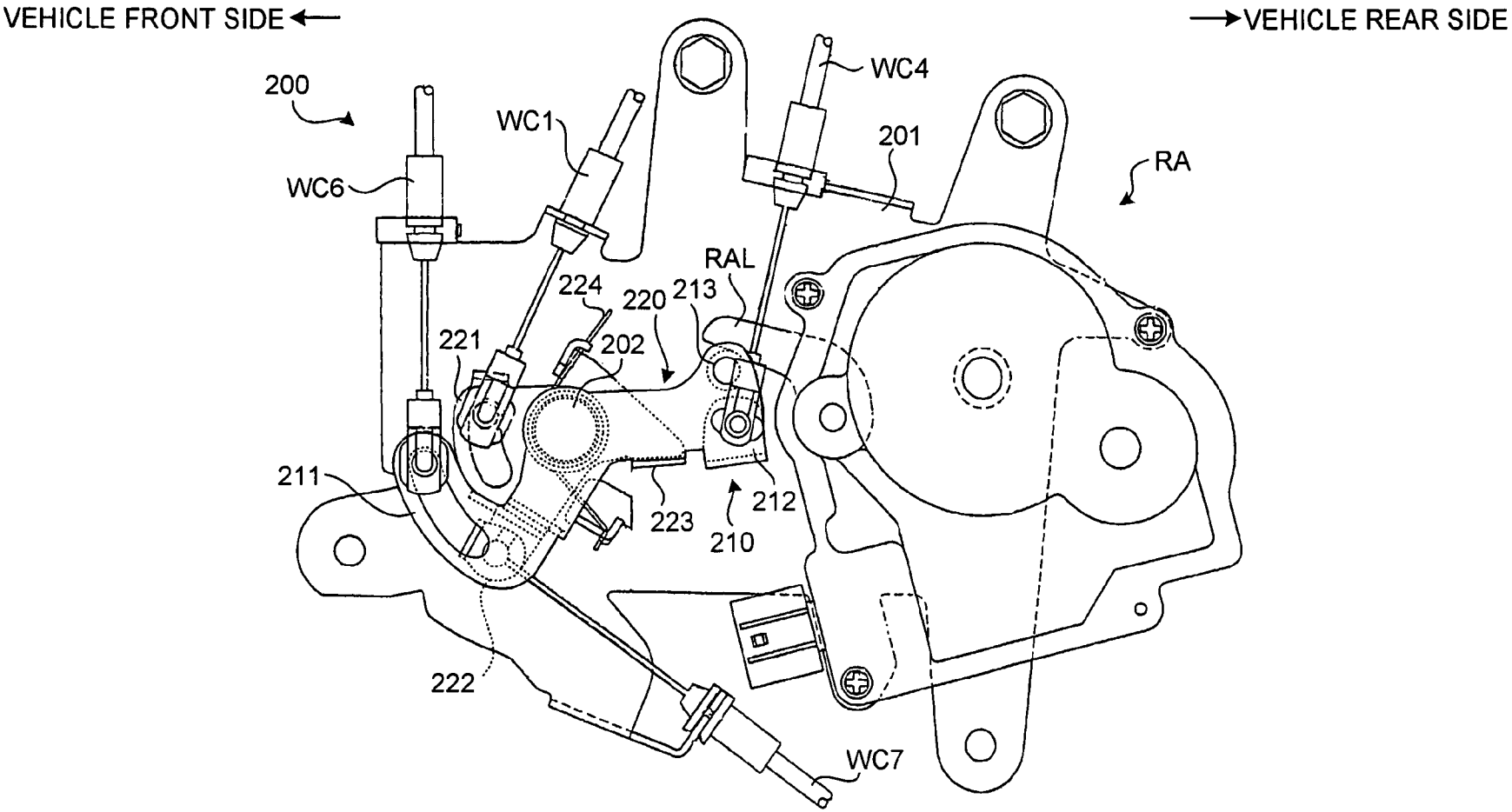
FIG. 19 is a side view of a link unit in the apparatus shown in FIG. 1 viewed from the interior side.

The link unit 200 mainly functions as a relay between an outer side knob OK, which is arranged on the outer panel OP, and the control unit 100, which is arranged on the inner panel IP. As shown in FIG. 19, the link unit 200 according to the present embodiment is arranged at a lower portion on a surface on the vehicle interior side of the inner panel IP. More specifically, the link unit 200 is arranged on the inner panel IP, through a link base plate 201, at a portion further below an opening/closing movement area of the window glass G. The link unit 200 includes a link shaft 202 that is arranged on the link base plate 201, an open knob lever 210 and an open knob sub-lever 220 that are arranged on the link shaft 202, and a release actuator RA that is arranged around the link shaft 202.

The open knob lever 210 is arranged on a front surface (on the vehicle interior side) of the link base plate 201 in such a manner that the open knob lever 210 is rotatable around the link shaft 202. The open knob lever 210 includes a sixth wire cable slide connecting unit 211, a fourth wire cable connecting unit 212, and an input unit 213. The open knob lever 210 includes a bend so as to make the open knob lever 210 extend downward from the link shaft 202 toward the vehicle front side, and then upward toward the vehicle front side. The sixth wire cable connecting unit 211 is arranged at a portion that extends upward toward the vehicle front side. An end of a sixth wire cable WC6 is slidably connected to the sixth wire cable slide connecting unit 211. Another end of the sixth wire cable WC6 is connected to the outside knob OK. The sixth wire cable WC6 functions to rotate the open side knob lever 210 clockwise in FIG. 19 when the outside knob OK is operated. In the present embodiment, the sixth wire cable WC6 is arranged to connect the outside knob OK and the open knob lever 210 in such a manner that the sixth wire cable WC6 passes below the opening/closing movement area of the window glass G, as shown in FIGS. 2 and 3. The fourth wire cable connecting unit 212 is arranged at a portion of the open knob lever 210 that extends from the link shaft 202 toward the vehicle rear side, and another end of the fourth wire cable WC4 is connected to a tip end of the fourth wire cable connecting unit 212. The input unit 213 is formed with a cylindrical collar that has a small-diameter in an upper portion at the tip end of the fourth wire cable connecting unit 212.

The open knob sub-lever 220 is arranged between the link base plate 201 and the open knob lever 210 in such a manner that the open knob sub-lever 220 is rotatable around the link shaft 202. The open knob sub-lever 220 includes a link-side first wire cable slide connecting unit 221, a seventh wire cable connecting unit 222, and an abutment protrusion piece 223. The link-side first wire cable slide connecting unit 221 protrudes from the link shaft 202 toward the vehicle front side. Another end of the first wire cable WC1 is slidably connected to a portion closer to the link shaft 202 than the sixth wire cable slide connecting unit 211 in the link-side first wire cable slide connecting unit 221. The seventh wire cable connecting unit 222 is arranged at a portion of the open knob lever 210 that extends downward from the link shaft 202 toward the vehicle front side. An end of the fully opening latch unit OR is connected to the seventh wire cable WC7. The seventh wire cable WC7 functions to cause a cancel operation for the fully opening latch unit OR when the cable WC7 is pulled. The open knob lever 210 includes a bend so as to make the open knob lever 210 extend from the link shaft 202 toward the vehicle rear side, and then from its lower edge toward the vehicle interior side. The abutment protrusion piece 223 is arranged at a portion that extends toward the vehicle interior side. The abutment protrusion piece 223 is abutted on a lower surface of the fourth wire cable connecting unit 212 through its upper surface. A pressing spring 224 is arranged between the open knob sub-lever 220 and the link base plate 201. The pressing spring 224 presses the open knob sub-lever 220 such that the open knob sub-lever 220 is always pushed counterclockwise in FIG. 19, thereby pressing the abutment protrusion piece 223 to have a contact with the lower surface of the fourth wire cable connecting unit 212.

The release actuator RA is arranged at a portion that is situated closest to the rear of the vehicle in the link base plate 201. The release actuator RA includes a release output lever RAL at a portion on the vehicle front side. The release output lever RAL is vertically rocked along a front surface of the link base plate 201, and is arranged such that an area in which release output lever RAL makes rocking movement passes through an area in which the input unit 213 makes rocking movement. In a normal state of the release actuator RA, the release output lever RAL is rocked most upward, and a lower end surface of the release output lever RAL is abutted on the input unit 213. In this state, no tensile force is generated across the sixth wire cable WC6 and the fourth wire cable WC4 connected to the open knob lever 210. Moreover, no tensile force is generated across the first wire cable WC1 and the seventh wire cable WC connected to the open knob sub-lever 220. When the third door operation detection sensor S3, for example, is turned on from this state, then the release actuator RA is driven in response to the ON state of the third door operation detection sensor S3 as a trigger to rock the release output lever RAL downward.

Figure 20:
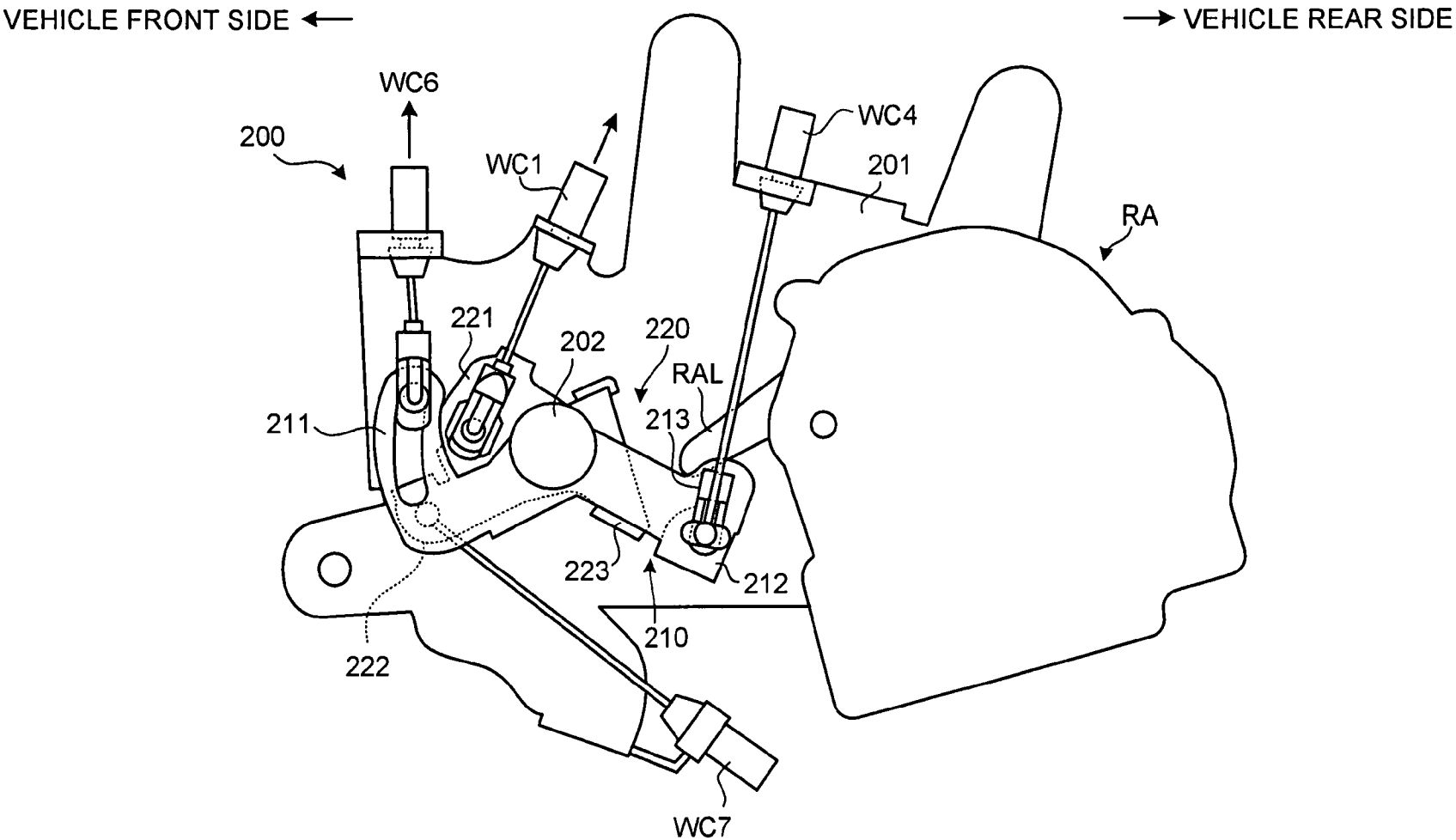
FIG. 20 is a conceptual view of the link unit shown in FIG. 19 when the outside knob is operated.
Figure 21:
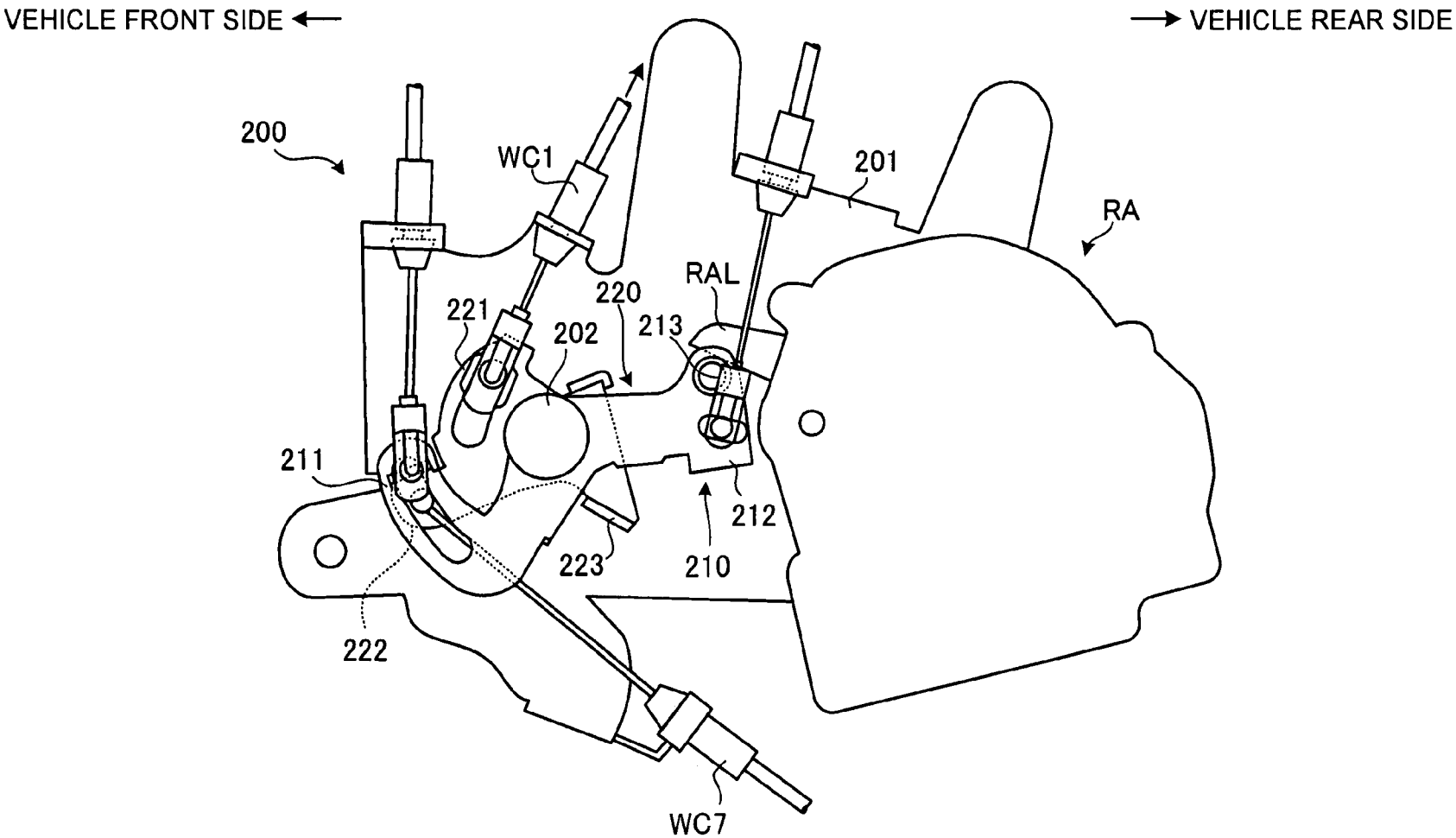
FIG. 21 is a conceptual view of the link unit shown in FIG. 19 when the inside knob is operated to close the door.

FIGS. 20 and 21 are conceptual views of the link unit 200 when the link unit 200 operates. Operations of the link unit 200 will be explained with reference to FIGS. 20 and 21 as well as FIG. 19 that depicts an initial state of the link unit 200.

In the initial state of the link unit 200, the release output lever RAL of the release actuator RA is rocked most upward, and none of the first wire cable WC1, the fourth wire cable WC4, the sixth wire cable WC6, and the seventh wire cable WC7 are pulled. Therefore, the control unit 100 connected to the first wire cable WC1 and the fourth wire cable WC4 is kept in the initial state.

When the outside knob OK is operated from this initial state, the open knob lever 210 rotates clockwise through the sixth wire cable WC6 as shown in FIG. 20, and the fourth wire cable WC4 is pulled. Furthermore, following the rotation of the open knob lever 210, the open knob sub-lever 220 rotates clockwise through the abutment protrusion piece 223, thereby pulling the seventh wire cable WC7. If the fourth wire cable WC4 is pulled and the lock unit 190 in the control unit 100 is unlocked, the open sub-lever 170 and the open lever 160 rotate clockwise as shown in FIG. 13. Thus, the second wire cable WC2 and the third wire cable WC3 are pulled, and the cancel operation for the front fully closing latch unit CRF and the rear fully closing latch unit CRR is perform. As a result, for example, even if the slide door D is fully closed, the slide door D can be opened and moved by operating the outside knob OK. Furthermore, when the seventh wire cable WC7 is pulled, the cancel operation for the fully opening latch unit OR is performed. As a result, for example, even if the slide door D is fully opened, the slide door D can be closed and moved by operating the outside knob OK.

On the other hand, if the first wire cable WC1 is pulled from the initial state, in other words, if the inside knob IK is rocked toward the vehicle front side and the second link lever 130 of the control unit 10 rotates counterclockwise as shown in FIG. 12 to thereby pull the first wire cable WC1, in the link unit 200, the open knob sub-lever 220 rotates clockwise at the same time as shown in FIG. 21. Thus, the seventh wire cable WC7 is pulled and the cancel operation for the fully opening latch unit OR is performed. As a result, for example, even if the slide door D is fully opened, the slide door D can be closed and moved by rocking the inside knob IK toward the vehicle front side. However, the open knob lever 210 does not rotate by pulling the first wire cable WC1. Therefore, for example, even if the slide door D is fully closed and the inside knob IK is advertently rocked toward the vehicle front side, the fully closed state of the slide door D is maintained, and it is possible to prevent the slide door D from being inadvertently opened and moved.

In the apparatus configured as above , the outside knob OK, the link unit 200, the control unit 100, the fully closing latch unit CR, and the fully opening latch unit OR are connected to one another by the wire cables WC1, WC2, WC3, WC4, WC5, WC6, and WC7. Due to this, even if a slight positional deviation occurs to each of the components of the apparatus while installing each of the components to the slide door D to assemble the apparatus, the positional deviations can be absorbed by the wire cables WC1, WC2, WC3, WC4, WC5, WC6, and WC7. In addition, an inspection and adjustment for the apparatus after the assembly becomes unnecessary, thereby facilitating the manufacturing of the apparatus.

Furthermore, the link unit 200 is arranged in the region below the opening/closing and movement area of the window glass G. Therefore, the sixth wire cable WC6 that connects the outside knob OK to the open knob lever 210 and the fourth wire cable WC4 that connects the open knob lever 210 to the open sub-lever 170 can be arranged in a line as straight as possible without interfering with the opening/closing movement area of the window glass G. Consequently, by operating the outside knob OK and the inside knob IK, the control unit 100 can operate smoothly and accurately without any transmission loss.

While in the embodiment described above, a case in which the apparatus is applied to the slide door D in the four-wheel vehicle has been explained, the door is not necessarily the slide door D. As long as a window of a door is opened or closed by an opening/closing member such as the window glass G, the present invention can be applied to the door arranged such that the door is opened or closed laterally or vertically on a hinge.

Moreover, while in the embodiment described above, the control unit 100 is arranged on the inner panel IP, and the link unit 200 connects the control unit 100 with the outside knob OK on the outer panel OP, the control unit 100 may be arranged on the outer panel OP, and the link unit 200 may connect the control unit 100 with the inside knob IK on the inner panel OP. In either case, it is unnecessary to arrange the link unit 200 on the inner panel IP, and the link unit 200 may be arranged on the outer panel OP.

Furthermore, while in the embodiment described above, the link unit 200 is arranged in the region below the opening/closing movement area of the window glass G, the link unit 200 may be arranged in a region other than the region below the opening/closing movement area, as long as the link unit 200 is positioned outside the opening/closing movement area.

Moreover, in the embodiment described above, the sixth wire cable WC6 that connects the outside knob OK with the link unit 200 is arranged in such a manner that the sixth wire cable WC6 passes through the region below the opening/closing movement area. However, the sixth wire cable WC6 is not necessarily arranged to pass through the region below the opening/closing movement area, and the sixth wire cable WC6 may be arranged to pass through a region on a front side or a rear side of the opening/closing movement area.

According to the present invention, the wire cable can be arranged in a line as straight as possible without interfering with the opening/closing movement area of the opening/closing member. In addition, it is possible to ensure that the apparatus operates smoothly and accurately without complicating the manufacturing of the apparatus.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. An apparatus for opening and closing a slide door of a vehicle, the apparatus being applied to a slide door that includes a window-opening/closing member that is arranged between a first door panel and a second door panel, and that moves to open or close a window opening, the apparatus comprising:

a first knob that is arranged on the first door panel on a vehicle exterior side;

a holding unit that holds the slide door in a fully closed state;

a door-opening/closing control unit that is arranged on a surface of the second door panel on a vehicle interior side, the door-opening/closing control unit including a second knob which is rotatably attached thereto and exposed on the vehicle interior side, the door-opening/closing control unit being configured to mechanically control opening and closing of the slide door by releasing the holding unit in response to an operation of the first knob or the second knob, said door-opening/closing control unit comprising a plurality of levers;

a link unit that is configured separately from the control unit and disposed below the control unit, the link unit being arranged at a lower portion on the surface of the second door panel on a vehicle interior side outside of a moving area of the window-opening/closing member, the link unit including a link base plate, a link shaft, and an open knob lever, wherein the link shaft is arranged on the link base plate, and the open knob lever is arranged on the link shaft;

a first wire cable that mechanically connects the link unit to the first knob; and a second wire cable that mechanically connects the link unit to the door-opening/closing control unit, wherein the open knob lever includes a first-wire connecting unit to which an end of the first wire cable is connected, and a second-wire connecting unit to which an end of the second wire cable is connected, the operation of the first knob is mechanically transmitted to the link unit through the first wire cable, and the operation transmitted is mechanically relayed by the link unit to the door-opening/closing control unit through the second wire cable, making the door-opening/closing control unit operate, and each of the first wire cable and the second wire cable is arranged in a substantially straight line without interfering with opening/closing movement of the window-opening/closing member.

2. The apparatus according to claim 1, wherein the door-opening/closing control unit includes a lock unit that is switched over between a locked mode and an unlocked mode, when the lock unit is in the locked mode, the lock unit invalidates the operation of the first knob, and when the lock unit is in the unlocked mode, the lock unit transmits the operation of the first knob to the holding unit to release the holding unit.

3. The apparatus according to claim 1, wherein the link unit includes a release actuator that assists releasing of the holding unit when the first knob is operated.

4. An apparatus for opening and closing a slide door of a vehicle, the apparatus being applied to a slide door that includes a window-opening/closing member that is arranged between a first door panel and a second door panel, and that moves to open or close a window opening, the apparatus comprising:

an outside knob that is arranged on the first door panel on a vehicle exterior side;

a first holding unit that holds the slide door in a fully closed state;

a door-opening/closing control unit that is arranged on a surface of the second door panel on a vehicle interior side, the door-opening/closing control unit including an inside knob which is rotatably attached thereto and exposed on the vehicle interior side, the door-opening/closing control unit being configured to mechanically control opening and closing of the slide door by releasing the first holding unit in response to an operation of the outside knob or the inside knob, said control unit comprising a plurality of levers;

a link unit that is configured separately from the control unit and disposed below the control unit, the link unit being arranged at a lower portion on the surface of the second door panel on a vehicle interior side outside of a moving area of the window-opening/closing member, the link unit including a link base plate, a link shaft, and an open knob lever, wherein the link shaft is arranged on the link base plate, and the open knob lever is arranged on the link shaft;

a first wire cable that mechanically connects the link unit to the outside knob; and a second wire cable that mechanically connects the link unit to the door-opening/closing control unit, wherein the open knob lever includes a first-wire connecting unit to which an end of the first wire cable is connected, and a second-wire connecting unit to which an end of the second wire cable is connected, the operation of the outside knob is mechanically transmitted to the link unit through the first wire cable, and the operation transmitted is mechanically relayed by the link unit to the door-opening/closing control unit through the second wire cable, making the control unit operate, and each of the first wire cable and the second wire cable is arranged in a substantially straight line without interfering with opening/closing movement of the window-opening/closing member.

5. The apparatus according to claim 4, wherein the control unit includes a lock unit that is switched over between a locked mode and an unlocked mode, when the lock unit is in the locked mode, the lock unit invalidates the operation of the outside knob, and when the lock unit is in the unlocked mode, the lock unit transmits the operation of the outside knob to the first holding unit to release the fully closed state.

6. The apparatus according to claim 4, wherein the link unit includes a release actuator that assists releasing of the first holding unit when the outside knob is operated.

7. The apparatus according to claim 4, further comprising a second holding unit that is arranged between the slide door and a body of the vehicle, and that holds the slide door in a fully opened state, wherein the second holding unit is controlled to release the fully opened state without releasing the first holding unit when the inside knob is operated to close the slide door.

* * * * *